US006675548B2

(12) United States Patent
Bristol et al.

(10) Patent No.: US 6,675,548 B2
(45) Date of Patent: Jan. 13, 2004

(54) METHOD AND APPARATUS FOR TEXTURIZING TANK WALLS

(75) Inventors: Gordon B. Bristol, El Cajon, CA (US); Robert A. Grogan, El Cajon, CA (US); Timothy M. Mathews, San Diego, CA (US); Stephen T. Rader, San Diego, CA (US); James L. Rogers, Ramona, CA (US)

(73) Assignee: DYK Incorporated, El Cajon, CA (US)

( * ) Notice: Subject to any disclaimer, the term of this patent is extended or adjusted under 35 U.S.C. 154(b) by 52 days.

(21) Appl. No.: 09/758,913

(22) Filed: Jan. 11, 2001

(65) Prior Publication Data

US 2002/0187730 A1 Dec. 12, 2002

Related U.S. Application Data

(60) Provisional application No. 60/229,422, filed on Aug. 31, 2000.

(51) Int. Cl.[7] ..... E04B 1/00

(52) U.S. Cl. ..... 52/745.01; 451/99; 451/70; 451/40; 451/75; 451/89; 239/287; 239/227; 239/124; 239/184; 239/120; 239/11; 239/135

(58) Field of Search ..... 451/99, 70, 40, 451/75, 89; 239/287, 227, 124, 184, 120, 11, 135

(56) References Cited

U.S. PATENT DOCUMENTS

| | | | | |
|---|---|---|---|---|
| 2,355,882 A | | 8/1944 | Malsbary et al. | |
| 2,784,034 A | | 3/1957 | Metcalf | |
| 3,000,036 A | | 9/1961 | DeBenedetti | |
| 3,182,425 A | | 5/1965 | Goss et al. | |
| 3,566,543 A | | 3/1971 | Fogle | |
| 3,709,436 A | | 1/1973 | Foster | |
| 3,726,481 A | | 4/1973 | Foster et al. | |
| 3,747,277 A | | 7/1973 | Carpenter et al. | |
| 3,848,804 A | | 11/1974 | Prestwich | |
| 3,877,643 A | | 4/1975 | Smith et al. | |
| 3,902,670 A | | 9/1975 | Koller et al. | |
| 3,908,314 A | * | 9/1975 | Watanabe et al. | 451/92 |
| 3,987,964 A | | 10/1976 | Pittman et al. | |
| 4,081,200 A | | 3/1978 | Cheung | |
| 4,149,345 A | | 4/1979 | Atsuchi | |
| 4,199,905 A | * | 4/1980 | Neidigh et al. | 451/92 |
| 4,219,155 A | | 8/1980 | Goerss | |
| 4,244,524 A | | 1/1981 | Wellings | |
| 4,285,469 A | | 8/1981 | Hammelmann | |
| 4,286,417 A | * | 9/1981 | Shelton | 451/2 |
| 4,302,979 A | | 12/1981 | Dykmans | |

(List continued on next page.)

FOREIGN PATENT DOCUMENTS

| | | |
|---|---|---|
| GB | 1327799 | 8/1973 |
| WO | PCT/GB84/00384 | 5/1985 |

*Primary Examiner*—Carl D. Friedman
*Assistant Examiner*—Steven Varner
(74) *Attorney, Agent, or Firm*—Stetina Brunda Garred & Brucker

(57) ABSTRACT

A gantry is constrained to move around the walls of a cylindrical, concrete tank. A rotating, high pressure water spray nozzle is mounted to a moveable platform on the gantry and connected to a source of water at a pressure of over 20,000 psi. The distance between the nozzle and an opposing surface of the wall of the tank is selected so the nozzle can remove the surface of the concrete and produce a selected surface roughness. The platform is moved vertically, with the gantry moving around the tank, so the surface of the concrete is systematically removed and roughened. A shotcrete or gunnite sprayer is then mounted to the platform, and the roughened surface sprayed with shotcrete or gunnite which sticks to the roughened surface. A tensioning head is then mounted to the platform, and wires or cables are tensioned as they are wrapped around the walls.

31 Claims, 12 Drawing Sheets

U.S. PATENT DOCUMENTS 4,370,836 A 2/1983 Hockett
4,416,092 A 11/1983 Nelson
4,443,271 A 4/1984 Goerss
4,536,635 A 8/1985 Shook
4,537,639 A 8/1985 Shook
4,600,149 A * 7/1986 Wakatsuki ..... 239/120
4,618,352 A 10/1986 Nelson
4,728,041 A 3/1988 Draxler et al.
4,736,805 A 4/1988 Shook et al.
4,753,549 A 6/1988 Shook et al.
4,780,064 A 10/1988 Olsen
4,793,734 A 12/1988 Shook et al.
4,802,628 A 2/1989 Dautel et al.
4,806,172 A 2/1989 Adaci et al.
4,825,598 A 5/1989 Schlick
4,877,638 A 10/1989 Novak et al.
4,879,859 A 11/1989 Dykmans
4,941,295 A 7/1990 Carpenter
4,964,731 A 10/1990 Virtanen
4,976,372 A 12/1990 Rogers, Jr.
5,024,382 A 6/1991 Shook et al.
5,042,208 A 8/1991 Richardson
5,078,161 A 1/1992 Raghavan et al.
5,080,056 A 1/1992 Kramer et al.
5,107,879 A 4/1992 Harvey
5,142,831 A 9/1992 Nelson
5,169,068 A 12/1992 Bertolini
5,170,940 A 12/1992 Salber et al.
5,203,507 A 4/1993 Matthews
5,205,084 A 4/1993 Roberts
5,217,163 A 6/1993 Henshaw
5,240,503 A 8/1993 Levy et al.
5,271,967 A 12/1993 Kramer et al.
5,316,786 A 5/1994 von der Lippe et al.
5,319,893 A 6/1994 Hockett
5,360,292 A 11/1994 Allen et al.
5,367,841 A 11/1994 Smith et al.
5,380,068 A 1/1995 Raghavan
5,380,564 A 1/1995 VanKuiken, Jr. et al.
5,396,738 A 3/1995 Vianna
5,419,734 A 5/1995 Van Sickle
5,423,348 A 6/1995 Jezek et al.
5,481,832 A 1/1996 Tirikos
5,489,234 A 2/1996 Hockett
5,512,318 A 4/1996 Raghavan et al.
5,529,530 A 6/1996 McPhee et al.
5,545,074 A 8/1996 Jacobs
5,605,496 A 2/1997 Pickard
5,636,789 A 6/1997 Shook
5,643,058 A 7/1997 Erichsen et al.
5,735,461 A 4/1998 Winther

* cited by examiner

METHOD AND APPARATUS FOR TEXTURIZING TANK WALLS

This application claims the benefit of provisional applications No. 60/229,422, filed Aug. 31, 2000.

BACKGROUND

Multi-million gallon storage tanks are commonly built with vertical walls of poured concrete. These walls are often stressed with wires, cables or bars. The wires, cables or bars are placed over a layer of shotcrete or gunnite. To ensure the shotcrete or gunnite adheres to the vertical tank walls, the walls are roughened or texturized by removing the top layer of material from the concrete surface. This is currently done by using sand blasting, bead blasting, or manual spraying with high pressure water.

The blasting methods leave a large amount of residue and can create clouds of dust, both of which are undesirable. Further, construction schedules do not allow much time to texturize the tank surface, and these tanks are very large: hundreds of feet in diameter and tens of feet high. To cover an adequate surface area in the time required, the blasting equipment is large, bulky, heavy and very noisy—all of which are undesirable. Efforts to reduce environmentally objectionable aspects such as dust clouds have resulted in large and heavy blasting recovery systems being used. But these systems are noisy, and leave blasting beads or sand distributed around the tank.

The manual water spraying is slow and produces inconsistent results because it is manually operated. The force from the manually operated sprayers is very large and can cause a sore shoulder if the spray guns are used for any length of time. Further, it requires positioning an operator around the tank wall and that poses some risk that the operator can fall off the support. Additionally, the operator must wear sound deadening headgear because of the noise, and that presents safety hazards.

There is thus a need for an improved way to quickly and safely texturize the vertical surfaces of these large storage tanks. There is a further need to texturize these tank walls while leaving no, or minimal residue. Moreover, there is a need to uniformly texturize the walls in order to avoid localized unbonded areas of shotcrete or gunnite.

It is therefore an object of this invention to provide a uniformly texturized surface on the vertical tank wall, with minimal environmental impact and where possible taking advantage of existing tank construction equipment. These and other objects of the invention are achieved by the following invention.

SUMMARY

A method for texturizing an exterior surface of a cylindrical concrete storage tank is provided by placing a rotating spray nozzle assembly having a plurality of nozzles so the nozzles maintain a predetermined distance from the tank surface during operation of the nozzles. The nozzle assembly is moved over the cylindrical surface while maintaining the predetermined distance and while forcing a jet of water through the nozzles with sufficient velocity and flow to remove an exterior layer of concrete from the surface along a strip having a width and a length, in order to provide a predetermined roughness to the surface. Preferably, but optionally, the method preferably fastens the nozzle assembly to a structure that is constrained to move around a circumference of the tank, and further fastens the nozzle assembly to a moveable platform on the structure which platform can move along a vertical axis. Preferably the method moves the structure and nozzle assembly around the circumference of the tank as moves the platform and nozzle assembly along the vertical axis. Preferably, the nozzle assembly moves in a spiral pattern around the tank so that strips of removed material slightly overlap for substantial portions of the length of the strips. Ideally, the nozzle assembly moves in a spiral pattern around the tank so that the strips of removed material do not overlap for substantial portions of the length.

The method can further comprise viewing the strip through a camera to obtain information for use in obtaining the predetermined roughness of the surface. Further, the water flows through the nozzles at a pressure, and the pressure is varied to compensate for wear of the nozzles and maintain the predetermined roughness of the surface. Advantageously over 90% of the surface of the storage tank is roughened by this method, and preferably over 95% is textured.

There is thus advantageously provided an improved method of making a concrete storage tank. The method includes forming a cylindrical tank having a vertical wall made of concrete, the tank having a footing extending radially outward from the walls. A gantry is tethered from a center pin extending from the roof. The gantry is configured to move around a circumference of the tank on the base. The gantry has a platform that can be moved upwards and downwards relative to the gantry and also has a spray nozzle assembly mounted to the platform so the nozzle assembly can move around the tank with the gantry, and up and down an exterior surface of the tank relative to the gantry. The nozzle assembly is moved over the exterior surface of the tank at a predetermined distance from the surface while spraying high pressure water through the nozzle assembly to provide a predetermined roughness to the exterior surface of the concrete over at least 90% of the surface. A coating material is then sprayed on the roughened surface. Cables, bars or wires may then be placed over the roughened surface covered by the coating material.

The above method also preferably places the spray nozzle assembly in fluid communication with a source of water through an opening in the top of the tank, although other sources of the water can be used. In order to prevent unacceptable damage to the wall, the nozzle assembly advantageously moves at a speed which is monitored and wherein the water pressure to the nozzle assembly is maintained at a pressure selected to avoid unacceptable roughening of the concrete wall. This can be achieved by comparing a signal representative of a rate at which the gantry is moving with a signal representative of a predetermined rate of travel, and varying the pressure of the water to the nozzle assembly and/or the speed of the gantry in order to vary the roughness of the wall produced by the nozzle assembly.

These and other methods are preferably implemented using an apparatus having a gantry with a wheel in contact with at least one of a surface of the tank or base to position the gantry relative to the tank, and a motor in driving communication with the wheel to move the gantry around the tank. A platform is mounted on the gantry and configured to move relative to the gantry. A rotating spray nozzle is mounted on the platform a sufficiently close distance to the surface of the tank to abrade and remove the surface when high pressure water is sprayed through the nozzle. Preferably, at least one spacing wheel is provided in a fixed position relative to the nozzle and in contact with the wall of the tank to control the distance between the nozzle and wall.

A pump is mounted on the gantry and in fluid communication with the nozzle. The pump is sized to provide water to the nozzle at a flow rate and pressure sufficient to remove at least the top layer of concrete on the tank wall opposite the nozzle.

The apparatus preferably, but optionally may have a controller having a first input representative of a speed at which the nozzle moves relative to the tank and having a second input representative of the water pressure at the nozzle, and has an output signal representative of a desired engine speed to achieve a pressure at the nozzle that is not sufficient to remove concrete from the tank wall opposite the nozzle. Preferably, the pump is sized to provide at least two gallons per minute of water at over 20,000 pounds per square inch to the nozzle, with the preferred pressure being about 36,000 to 40,000 psi. Advantageously as the nozzle removes a strip of material from the wall, a camera is supported by the gantry and located and orientated to provide an image of the strip of material shortly after the strip is formed by the nozzle. An operator can adjust the water pressure, or the speed between the nozzle and wall, or the distance between the nozzle and the wall, in order to vary the amount of texturing. Additionally, a shield is preferably located intermediate the nozzle and the platform, with the shield being configured to block a majority of the debris ejected from the walls from hitting the platform during use of the apparatus.

Preferably the spacing between the nozzle and the wall being textured is maintained using a roller connected to a frame to which the nozzle is connected, the roller being located so it can be placed in contact with the wall adjacent the nozzle to maintain a predetermined distance between the nozzle and the wall. The nozzle is slidably mounted to allow movement relative to the platform along an axis generally perpendicular to the wall, and preferably that movement can be controlled by an operator to allow remote adjustment in order to vary the texturizing of the wall.

DESCRIPTION OF THE DRAWINGS

Further features and advantages of the invention will be better understood by reference to the following detailed description and drawings in which like numbers refer to like parts throughout, and in which.

DETAILED DESCRIPTION

Figure 1:
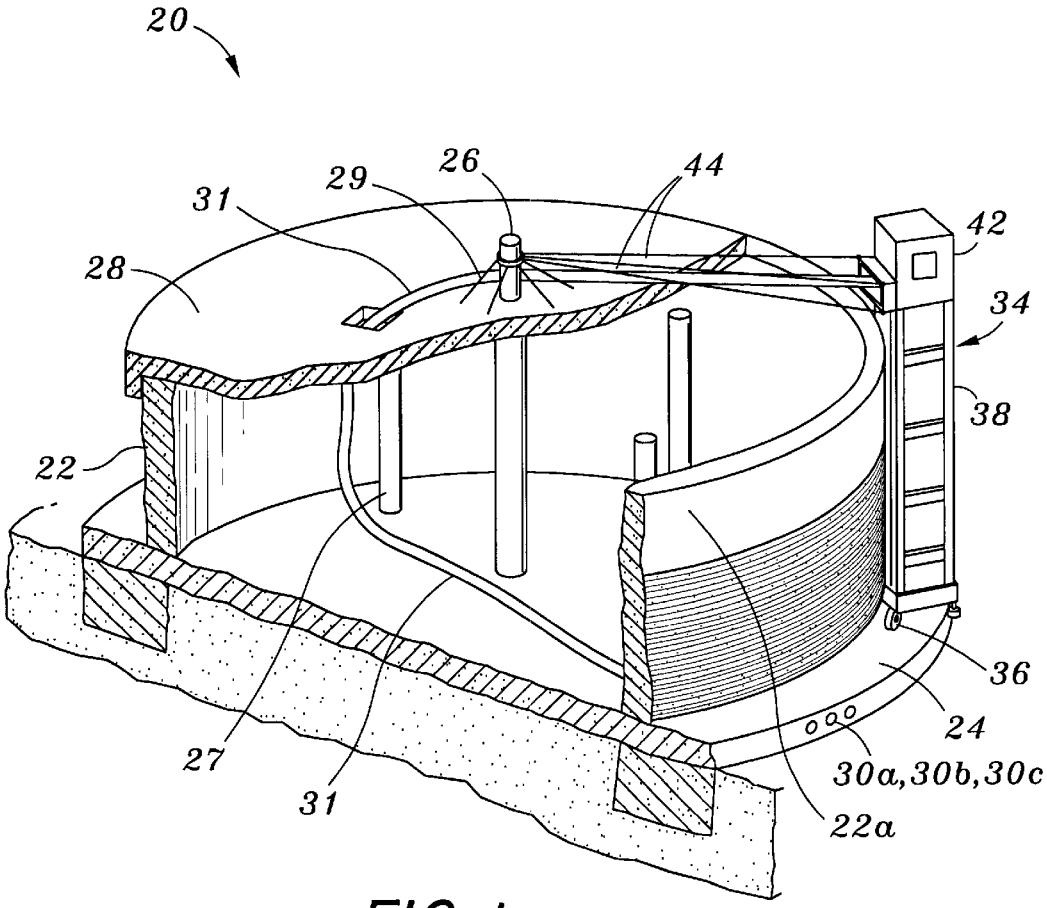
FIG. 1 is a perspective view of a storage tank.
Figure 2:
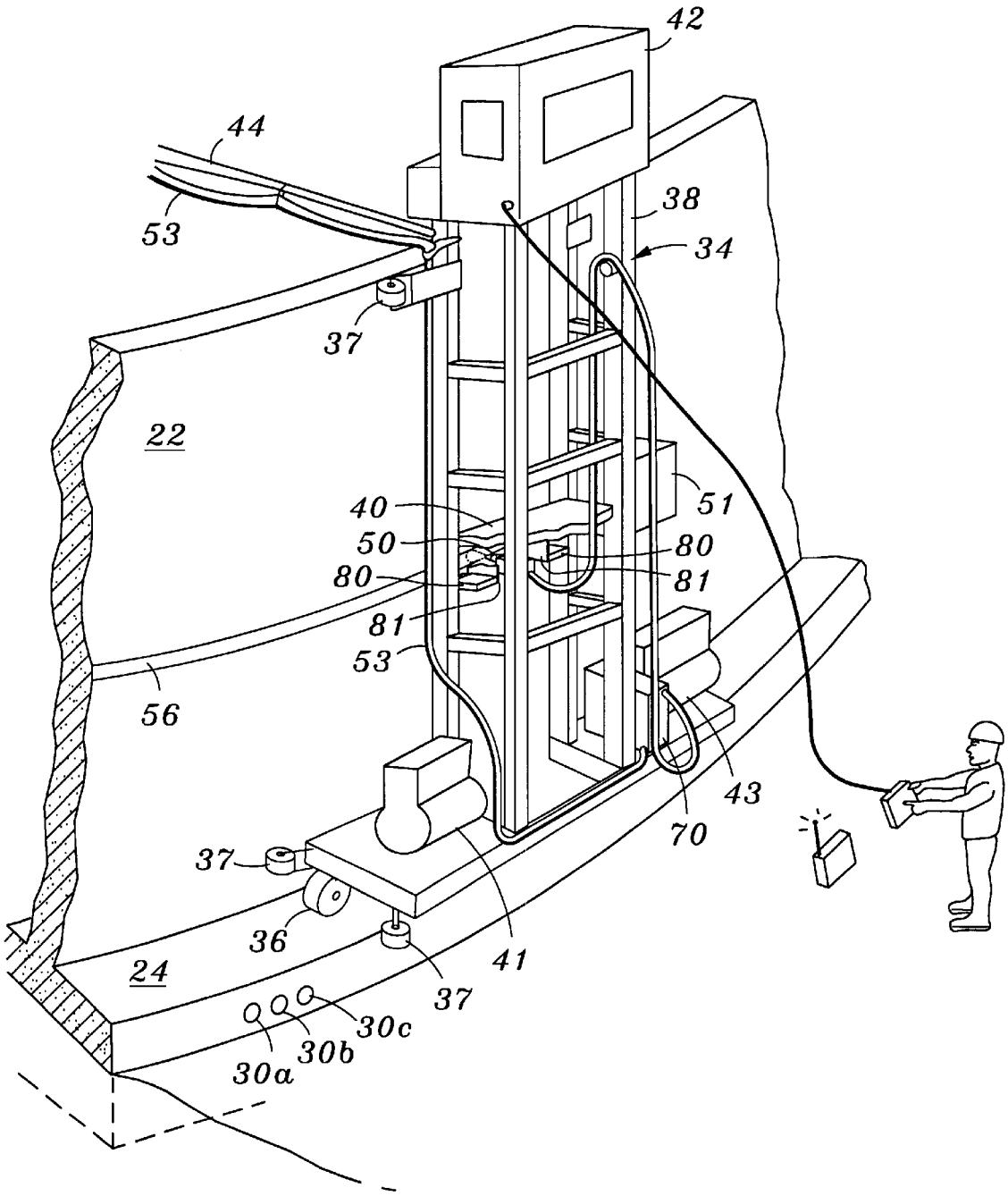
FIG. 2 is a partial perspective view of a portion of a storage tank using a spray system of this invention.

Referring to FIGS. 1 and 2, a storage tank 20 has walls 22 that are vertical within the construction tolerances for such tanks, and those tolerances typically result in walls vertical within 1 degree or less. The walls extend upward, away from the ground. The walls 22 are generally parallel although they may be wider at the bottom, adjacent the ground and narrower at the top, away from the ground. The walls 22 form a cylindrical structure from tens of feet in diameter to several hundred feet in diameter, and from 5–120 feet high, capable of holding several hundred thousand to tens of millions of fluid, such as water, chemicals, petroleum products or sewage. The walls 22 are formed on a generally horizontal base 24 that takes the form of a disk, extending across the entire bottom of the cylindrical tank 20. The base 24 typically includes a footing around the periphery of the wall and beneath the wall, but the design can vary. For example, sometimes the wall and footing are separated, but adjacent structures. Advantageously, the footing extends several feet radially outward from the exterior surface 22*a* of the walls 22 to provide a support for equipment as discussed later. Internal supports 27 and a roof 28 are typically placed on tanks 20.

A tubular, center pin or center post 26 connected to a portion of the tank. The center post 26 is preferably located at the center of the roof 28 of tank 20, on the outside of the tank. The center pin provides a central pivot at the center of the top of the tank 20. The center pin can take various forms, but preferably comprises a tube extending vertically from the roof 28 of the tank, although it could extend from the floor of the tank. The tube can be permanently fastened to the roof, but is preferably removably fastened by having a plurality of guy-wires 29 attached to the post 26 with the other ends of the wires connected to the roof in order to stabilize the post 26. A number of bolts can be embedded in the roof to allow connections to the cables and to the bottom of the center post 26. A rotatable collar is provided on the center pin 26, distal of the guide wires 29.

One or more hoses run between the center pin 26 and an end of pipes 30 that extend from the exterior of the tank to the interior of the tank 20. There is typically an access opening in the roof 28, and the hoses 31 extend through that access opening. Preferably there are three pipes 30*a*, 30*b*, 30*c* placed in the footing (FIG. 1) with the pipes extending beneath walls 22 and then opening onto the floor of the tank formed by base 24. Advantageously various materials can be pumped through one of the pipes 30 and carried by a hose 31 to the top of the center pin 26 and from there through a tube that extends to the walls 22 to provide materials for use in finishing the tank 20. Air, water, gunnite or shotcrete can be carried through the pipes 30 and tubes 31. The pipes 30 are advantageously plugged after the tank 20 is completed.

A moveable gantry 34 is mounted to travel on the base 24 around the exterior of the walls 22. The gantry 34 has wheels 36 that support the gantry on the horizontal base 24, with guide wheels 37 that are urged against vertical edges of the base 24 or the wall 22 to guide the gantry around the curved periphery of the base 24. The gantry 34 has supports 38 extending upwards toward the top of the walls 22, with a moveable platform 40 mounted on the supports 38 so that the platform can move relative to the gantry. Preferably the platform 40 moves vertically between supports 38, and is driven by a chain drive, although other drives can be used such as gear drives, belt drives, hydraulic lifts, etc. An operator station may be located on the gantry 34 in either a fixed or moveable location, or it may be remote from the gantry. Advantageously the operator station 42 is mounted on the top of the gantry. A gantry motor 41 and a pump motor 43 are preferably mounted at the bottom of the gantry, closer to the base 24, and preferably on opposing sides of the supports 38 in order to balance the weight on the wheels 36.

As needed, a tether 44 extends from the rotatable collar on center pin 26 to the gantry 34 to prevent the gantry from tipping away from the tank 20. The tube 31 carrying the gunnite or shotcrete used to coat the walls 22, can also carry air or water to the gantry 34, and is preferably suspended from the tether 44. Rather than a tether, wheels 46 (FIG. 13) or other moveable or slideable support surfaces could be placed against the inside surface 22*b* of the walls 22 in order to stabilize the gantry 34. Advantageously the motor 41 provides power to operate a number of moveable parts on the gantry 34. The power from motor 41 is preferably used to generate hydraulic pressure and drive hydraulic drive motors, but other sources of movement could be used for actuation of various components, such as gears, belts, chains or electric motors. As the motor 41 can generate electricity, a wide variety of drives can be used.

The gantry 34 can be moved around the exterior of the tank 20 by the motor 41 being placed in driving communication with the wheels 36. The gantry movement is under the guidance of an operator. By suitable control cables or wireless connections, the operator can control the movement of the gantry and platform from a location removed from the gantry, as shown in FIG. 2. Various designs can be used to place the operator at various locations on the gantry or remote from the gantry 34.

After the walls 22 are poured and sufficiently hardened, they are wrapped with cables or wires and stressed in order to strengthen the walls. But the exterior surface 22*a* of the walls has various latent materials on it that are undesirable for various reasons. One disadvantage of these latent materials is that they may cause metal cables or bars to corrode, thus causing a variance in the strength of the tank 20 over time. Further, the latents inhibit satisfactory bonding of shotcrete or gunnite to the walls. Thus, the exterior layer of the wall 22 is preferably removed and replaced with a material of known and more uniform composition to protect the cables or wires.

Removal of this layer of material from the wall 22 is preferably achieved by placing a high pressure spray nozzle on a movable structure that can maintain the water nozzle fairly a constant distance from the exterior surface 22*a*, and that can move the nozzle in a pattern over the surface of the wall 22 to appropriately and uniformly roughen the wall and remove a predetermined amount of material from the surface 22*a*. Given the disclosure herein, by suitable reconfiguration, the nozzle can be located inside the tank 20 or on other vertical surfaces.

Figure 3:
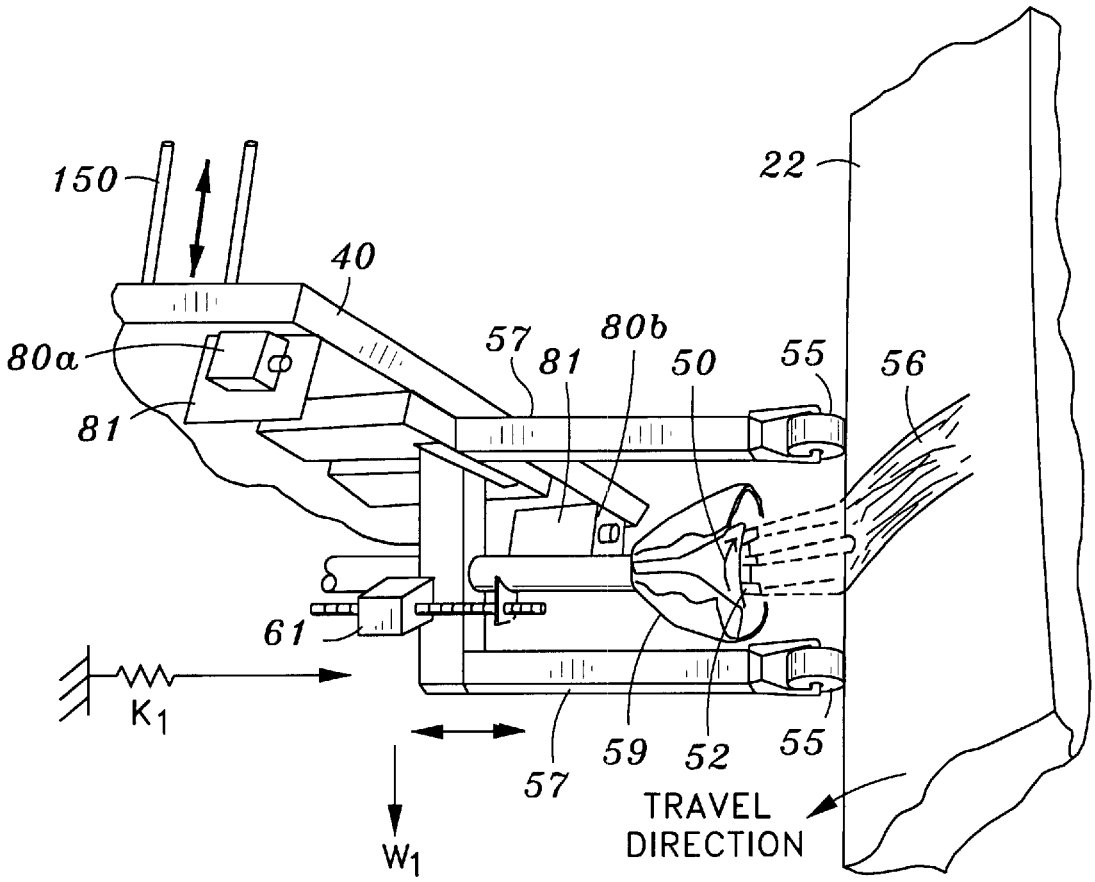
FIG. 3 is a partial perspective view of a spray system of this invention.
Figure 4:
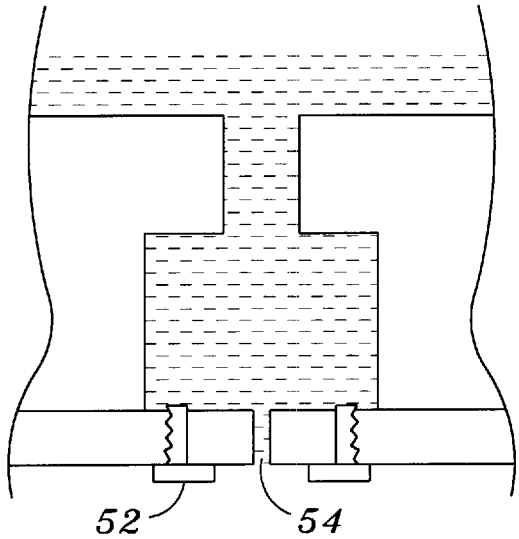
FIG. 4 is an illustrative sectional view of a nozzle used in the spray system of FIG. 3.

Referring to FIGS. 2–4, a nozzle assembly 50 is shown which has a plurality of nozzles 52 that rotate about a central axis of the assembly 50. Water is supplied to the nozzle assembly 50 through one of the pipes 30, hose 31, center pin 26 and hose 53 suspended from tether 44. Alternatively, the hose 53 could be connected to a portable water reservoir, including water reservoir 51 (FIG. 2) located on the gantry 34, but the weight limitations of the base 24 and/or wall 22 make placement on the gantry undesirable.

The nozzle assembly 50 is held a predetermined, and preferably a constant distance from the wall 22. This spacing can be provided several ways, including using at least one low friction spacer, such as a sliding, or preferably a rolling contact, as illustrated by spacing wheel 55 that is connected to the nozzle assembly 50 by a support 57. A spacing between the wall 22 and the nozzle assembly 50 of about 0.5 to 8 inches is believed suitable. Spacings of 1–3 inches are believed to be better, and a spacing of about 2¼ inch is preferred for a speed of about 75 feet per minute and a spray width of about 6 inches. Advantageously the spacing between the nozzle and the wall 22 is substantially constant, varying about 0.5 inch or less toward, or away from the wall 22.

But variations in the base 24 on which the gantry rides can move the gantry and thus move the nozzle assembly 50 relative to the wall. Further, variations in the wall 22 can cause it to move relative to the gantry 34 and thus move relative to the nozzle assembly 50. These variables cause the distance between the nozzle assembly 50 and the wall 22 to vary. To maintain this distance constant, some sort of adjustment mechanism is needed and is preferably provided. This can be achieved various ways, through rolling contact spacers, sliding contact spacers, electronic, non-contact spacing assemblies, or optical, non-contact spacing assemblies. For simplicity, there is preferably some sort of mechanism contacting the wall to maintain the desired spacing. But it is also believed possible to maintain the spacing by enclosing the area immediately around the nozzle assembly 50 with a shroud or shield, in order to create a localized high pressure area that uses the water from the nozzle assembly to force the nozzle assembly away from the wall 22. If the structural support of the nozzle assembly 50 has a defined stiffness, then a predetermined pressure arising from the shrouded nozzle assembly can maintain a predetermined distance between the nozzle assembly and the wall 22. The force arising from the nozzle, the stiffness of the nozzle support, and the deflection of that support are related by known equations and can be determined. The closer the nozzle assembly 55 gets to the wall, the greater the pressure or force within the shrouded area, and that force moves the nozzle away from the wall.

As seen best in FIG. 3, the spacing wheel(s) 55 are advantageously located in the same vertical plane as the nozzle assembly 50, but the wheel(s) 55 could be in the same horizontal plane as the nozzle assembly 50. The wheel(s) 55 are preferably spaced sufficiently close to the nozzle assembly 50 so that any variations in the surface of the wall 22 do not cause the nozzle assembly 50 to come close enough to the wall to cause an unacceptable abrasion of the wall during use of the nozzles, and do not cause the nozzle assembly 50 to move far enough from the wall to leave concrete that is insufficiently roughened. Variations in the surface 24 on which the gantry 34 travels, and variations in the roundness of the wall 22, can result in the nozzle assembly 50 moving relative to the wall 22.

Maintaining the desired positioning of nozzle assembly 50 can be achieved by connecting the nozzle assembly 50 and the wheels 55 to a common framework containing two generally parallel supports 57 onto each of which a wheel 55 is mounted, with a cross-member joining the supports 57. Each wheel 55 is ideally placed very close to the edge of the strip 56 of removed material so that the spacing between the nozzle assembly 50 and the wall is maintained as closely as possible and tracks the contour of the wall 22 as close as possible. Spacings of under 6 inches from the rotational axis of the spray nozzle assembly 50 to the centerline of wheel 55 are desired. But the debris ejected from the wall 22 damage the wheels 55, so a further spacing is preferable from a wear and maintenance viewpoint. A spacing of 6–12 inches between each wheel 55 and the central axis about which the nozzle assembly 50 rotates, is believed suitable. Because the spacing wheels 55 are subjected to harsh operating conditions with the water spray and ejected debris, sealed bearings on the wheels are preferred. Polyurethane wheels are preferred over rubber ones.

The nozzle 50 passes through the cross-member joining supports 57 so that the nozzle moves with the wheels 55 toward and away from wall 22. The nozzle 50 and wheels 55 are mounted so they can move relative to the gantry 34 and preferably also move relative to platform 40, along an axis generally orthogonal to wall 22. A mechanism preferably resiliently urges the wheels 55 against the wall 22. A dead weight W1 can be connected to resiliently urge wheels 55 against the wall 22 if the location and geometry of the frame is appropriate. Alternatively, a spring K1 interposed between the platform 40 and the frame can resiliently urge the wheels 55 against the wall 22. FIG. 3 shows such a resilient mount conceptually. Various structures other than a spring can resiliently urge the wheels 55 against the wall 22, including a hydraulic ram, a pneumatic ram, or some combination of either of those with a spring. The ultimate result is that the nozzle 50 can move relative to the platform 40 along an axis generally orthogonal to the wall 22 as the wheels 55 move along the surface of the wall 22, with the nozzle assembly 50 moving with the supports 57 that hold the wheels, so as to maintain the nozzle assembly 50 at a predetermined distance from the wall 22. Various mechanisms can be used to physically contact the wall 22 and control the distance of the nozzle relative to the wall.

Still referring to FIG. 3, the nozzle assembly 50 is preferably mounted so that it can be adjustably positioned relative to the wheels 55 in order to set the distance between the nozzle assembly 50 and the wheels 55. This could be done by manually positioning the shaft to which the nozzle assembly 50 is mounted, and then fastening it to the framework to which the wheels 55 and shaft are fastened. A variety of releasable locking mechanisms could be used to do this, including clamps, latches, pins fitting in holes in the shaft, or sliding a holder for the shaft of the nozzle assembly along a tube and bolting or clamping it in place on the tube. But advantageously the positioning is adjusted remotely and controlled by the operator, preferably through the operator control 42. This may be achieved by use of a remotely controlled drive system to move the nozzle assembly 50 relative to the platform 40. Preferably, a motor driven rotating screw is used, although geared mechanisms, hydraulic actuated assemblies, or pneumatic actuated assemblies could also be used to position the nozzle assembly 50 relative to the gantry, and/or relative to the wheels 52.

As illustrated, a jackscrew assembly 61 mounted off of platform 40 to move the nozzle assembly 50. Advantageously, the jackscrew assembly 61 is mounted to the framework holding wheel(s) 52 and through which the shaft of the nozzle assembly 50 extends so as to move the shaft and nozzle assembly 52 relative to that framework. Thus, the motor of the assembly 61 is preferably connected to the frame 57 so as to rotate the jack-screw, with a non-rotating nut being connected to the shaft of the nozzle assembly 50 so that rotation of the jack-screw causes the nut and nozzle assembly 50 to translate. By controlling the jackscrew assembly 61, the nozzle assembly 50 moves toward and away from the wall 22 while the wheel(s) 55 remains resiliently urged against the wall. This allows adjustment of the spacing, and allows varying the width of strip 56 removed from the wall 22 during operation.

In an alternative embodiment, the wheel(s) 55 can be removed, and a sensor placed on the frame 57 or a relatively stationary portion of the jackscrew assembly 61 in order to detect the distance between the wall 22 and the sensor, with that information being used to determine the distance between the wall 22 and the nozzle assembly 55. The drive assembly, such as jackscrew assembly 61, can then use the position information to move the nozzle assembly and maintain the position of the nozzle assembly 50 relative to the wall 22. The distance determining sensor must be able to function in the ejected debris, and must be able to provide distance information even though debris will likely be ejected through the sensor path. Sensors such as infrared sensors, ultrasonic sensor, or visual sensors could be used, with appropriate electronic systems to filter out the noise caused by the ejected debris.

As the nozzle assembly 50 approaches the wall 22, it will be hit by more of the debris ejected from the wall 22. Because of the ejected debris, it may be useful to have a shield 59 (FIG. 3) to deflect at least some of the ejected debris from hitting equipment or bystanders, and to collect and concentrate the debris. The shield 59 is preferably sized and shaped and located so that it blocks the majority of debris ejected from the wall 22 from hitting the platform, and also preferably entraps the majority of the debris ejected from the walls 22 during spraying, and with the aid of gravity and the accompanying water spray, causes the debris to flow or fall down into a container or in to a predetermined location for easy collection. Preferably, the shield 59 collects about 50–80% of the ejected latents and lets them drop onto a pile extending along the base 24. If desired, a low pressure could be applied to the inside of the shield to vacuum the debris into a container for collection and disposal.

The nozzle assembly 50 is preferably such that one or more, and preferably three nozzles 52 rotate about a central axis. The central axis is preferably maintained perpendicular to the adjacent surface of wall 22. The nozzles 52 are orientated on the assembly 50 so that the jets of water from the individual nozzles 52 are angled relative to the adjacent surface of the wall 22, preferably at an angle of about 15 degrees from the rotational axis. The jets from the nozzles 52 may also, optionally, be angled slightly so as to impart a rotation to the nozzle head 50.

Each nozzle has an opening 54 through which high pressure water exits. The openings 54 are preferably circular so that the jet of water exiting the nozzle 52 is a generally cylindrical stream of spray, which preferably does not expand much. When rotated by the nozzle assembly 50, this produces a circular path on the adjacent surface of the wall 22, with the diameter of the circle varying with the distance of the nozzle assembly 50 from the wall 22. The nozzle assembly 50 is moved across the surface of the wall 22, with the water pressure texturizing the surface of the adjacent wall 22.

By varying the rotational speed of the nozzle assembly 54, the water pressure, the flow rate of the water, the opening 54, and the speed at which the nozzle assembly 52 is moved over the surface of the wall 22, and the distance of the nozzles 52 or nozzle assembly 50 from the adjacent surface of the wall 22, various textures and production rates can be achieved on the surface of the wall 22 hit by the high pressure water. As used herein, high pressure water refers to a water pressure of about 20,000 psi or greater, with the preferred pressure being over 30,000 psi. Nozzle openings varying from about 0.016 to 0.030 inches are believed suitable for water pressures of 30–40 thousand pounds per square inch, with flow rates of 6–12 gallons per minute and nozzles 54 spinning at about 3,000 rpm with the nozzles 54 being about 2–5 inches from the surface 22*a* of wall 22 and with the nozzle assembly 50 moving at about 50–110 feet per minute to achieve an ICRI surface of about 5–6 or greater. By placing the nozzle assembly 50 closer to the wall so that it covers a strip about 2.5 inches wide on the adjacent surface of the wall 22, a speed of about 110 feet per minute of the nozzle assembly 50 can be achieved while producing an ICRI surface roughness that is preferably about 5–6, and could be higher as long as the structural integrity of the wall 22 is maintained. ICRI stands for International Concrete Repair Institute. By placing the nozzle assembly 50 further from the wall to achieve a width of the strip 56 of about 4.5 inches, the nozzle assembly 50 can be moved at a speed of about 75 feet per minute.

Figure 8:
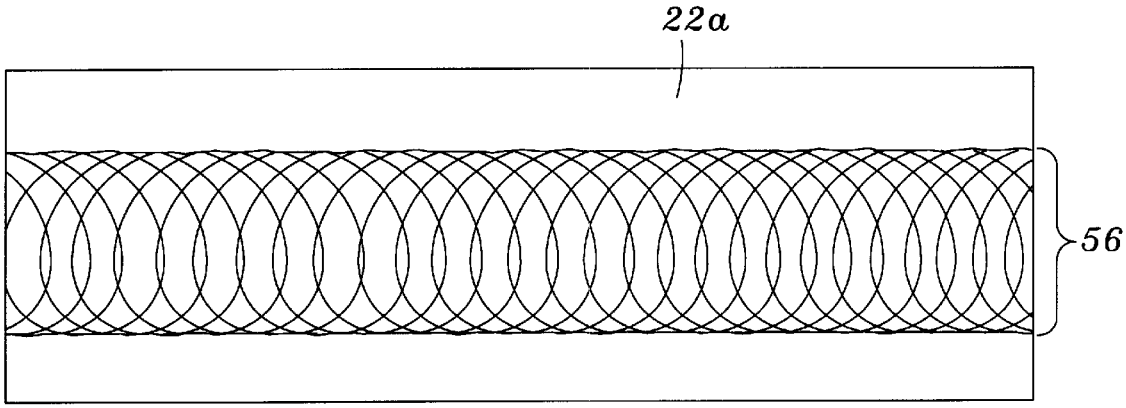
FIG. 8 is an illustration of a texturing pattern produced by spray nozzles of the invention of FIG. 1 where the surface is incompletely textured.

As the nozzles 54 rotate, they produce a circular spray pattern on the adjacent wall 22. If there is not enough pressure or if the rate of travel of the nozzle assembly 50 is too great, then the circular patterns do not overlap but instead separate and leave untextured surface, as shown in FIG. 8, or an insufficiently textured surface. A uniformly textured surface with an ICRI roughness of 5–6, over at least 90% of the surface of the exterior wall 22*a* is desired to ensure adhesion of the shotcrete or gunnite. That roughness over 95% of the surface of the exterior wall 22*a* is preferred, with greater percentages of coverage being even more desirable. In these instances the remaining 5–10% of the wall where shotcrete will be applied is also textured, it is just not textured to the desired amount, or there are small strips of untextured wall. Preferably, there is no more than 1 ICRI variation over the tank surface. Other surface textures and criteria could be used for different applications or in different situations or for different materials.

Figure 6:
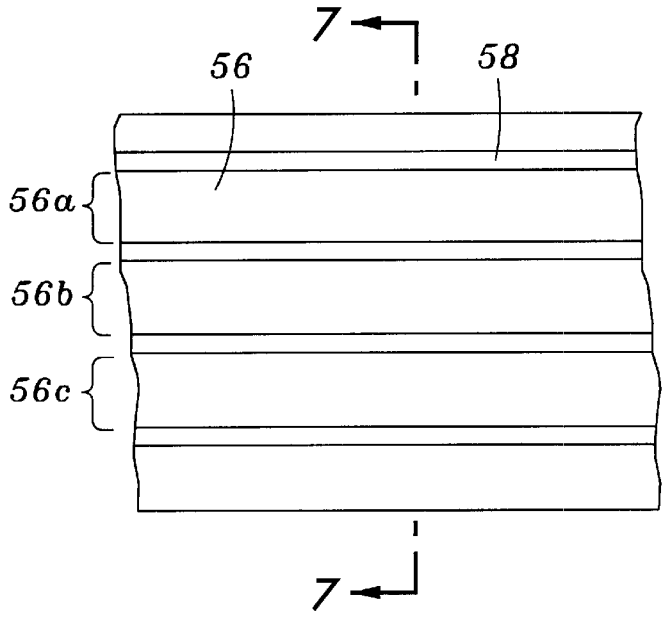
FIG. 6 is a plan view of a portion of a textured concrete wall.
Figure 7:
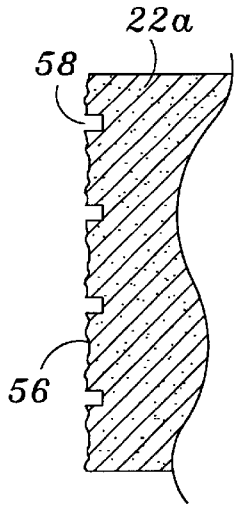
FIG. 7 is a sectional view along Section 7—7 of FIG. 6.

Referring to FIGS. 6–8, the nozzle assembly 50 creates a spray with a defined width that increases the further the assembly 50 is from the wall 22. But the further the nozzle 50 is from the wall 22, the lower the force of the water on the wall 22, and the less the texturing, for a given water pressure and flow rate. Because the nozzle assembly 50 creates a strip 56 of texturing on the wall 22, the nozzle is preferably moved in a pattern that places the textures strips 56 immediately next to each other, or that slightly overlap each other. Advantageously, the adjacent textured strips 56 overlap each other by about 1/16 to 1/8 of an inch continuously along the length of the strips 56. It is desirable to avoid substantial lengths in which there is no overlap or abutment of adjacent strips 56 that would create ridges of untextured wall 22. As used here, a substantial length refers to a distance comprising 1/3 or more of the distance (circumference for cylindrical tanks) around the periphery of the tank 20. An untextured strip of about 0.25 inches by 50 foot long is such a substantial length that is undesirable. At the location of the overlap, a slightly deeper cut 58 in the concrete wall 22 occurs because of the repeated application of the high pressure water.

In some situations, it may be desirable to specify the overlap between adjacent strips 56 in order to form a shaped groove 58 or textured ridge on opposing edges of the strips 56, so the groove 58 can be used to form regularly occurring, increased strength connections with the material (e.g., shotcrete or gunnite) that is applied to the textured surface 22. One example is toward the top of the tanks where no cable or wire is applied. A parapet wall is one extreme example of this.

Other configurations of nozzles 52 can be used, but are not as preferred. For example, nozzles with rectangular or slit-like openings are made that produce a fan configuration rather than a conical configuration of spray. But the rectangular openings wear faster and are thus less desirable. Further, either the fan nozzles, or the conical openings 54 on nozzles 52 could be mounted in a non-rotating configuration. But if they are non-rotating the coverage area is smaller. That would require a different movement scheme of the gantry 34 and platform 40 in order to achieve a sufficient rate of removing the concrete from the wall 22, or it would require grouping a plurality of nozzles together in order to increase the coverage.

Referring to FIGS. 6–7, the surface roughness produced by the spray assembly 50 is preferably uniform over the surface of the tank walls 22, although in some instances slightly deeper cuts 58 may be acceptable in order to ensure removal of untextured surfaces. The complete coverage is advantageously provided by moving the nozzle assembly 50 around the periphery of the tank 50 and then either lowering the nozzle assembly 50 by the width of the strip 58, or by inclining the strip slightly to form a continuous spiral down the side walls 22 of the tank 20.

Thus, for example, the nozzle assembly 50 can be held at a fixed height relative to the base 24, or relative to the top edge of the tank 20, and the gantry 34 moved around the periphery of the tank walls 22 in a circular pattern. Preferably the gantry 34 begins moving and then the water pressure through the nozzles 52 is increased to a pressure that cuts the concrete walls 22. If sufficient water pressure is provided to the nozzle assembly 50 while the nozzle assembly is stationary, a hole will be bored into the concrete walls 22. Thus, the nozzle assembly 50 is preferably moving when water pressure sufficient to abrade the wall 20, is provided to the nozzles 52. The rate of travel of the nozzle assembly 50, or of the gantry 34 to which the nozzle assembly 50 is mounted can be monitored and used to ensure a sufficient motion of the nozzle assembly 50 occurs so the high pressure water does not unacceptably damage the surface of the tank 20. The monitoring can be achieved by various ways, such as monitoring the speed of drive motors, the rotational speed of drive or driven wheels, visual inspection, or other ways of actually measuring the travel rate of the nozzle assembly 50, or of calculating the travel rate.

Alternatively, a tumble box or bypass valve could be provided such that if the water pressure reaches a predetermined pressure as measured by a pressure gage, and if the travel speed of the gantry 34 is below a minimum speed, then the water is diverted from nozzle assembly 50 and sent to the tumble box or bypass valve in order to avoid boring a hole in the concrete. The tumble box could allow water from the box to overflow onto the ground, or it could recycle the water for reuse by the nozzle assembly 50.

When the gantry 34 has circled the tank 20 and beginning of the strip 56 is reached, the water flow and gantry movement can be stopped, the nozzle assembly 50 moved upward or downward an appropriate distance, and the gantry motion and spraying resumed. But this process is slow.

Advantageously, the gantry 34 moves continuously. Preferably, the nozzle assembly 50 is elevated or lowered while the nozzle assembly 50 is moving in a circular pattern around the entire circumference of the tank, with a slight overlap in the texturized areas and strips 58, occurring. This produces a number of generally parallel strips 56 with areas of overlap or double texturizing where the nozzle assembly 50 is moved to create the next strip. Alternatively, a gradual spiral can be used, either upward or downward, around the periphery of the tank The spiral results in a number of generally parallel, but slightly inclined strips 56. Alternatively, vertical strips 56 could be produced by moving the platform 40 upward or downward, with the gantry 34 being moved around the periphery of the tank 20 in order to shift the strips 56.

Referring to FIGS. 2–3, the upward and downward elevation of the nozzle assembly 50 is provided by controlling the motion of the nozzle assembly 50. This can be achieved by mounting the nozzle assembly 50 on the platform 40, and moving the platform relative to the gantry 34 and its vertical members 38. A chain driven by a hydraulic motor controlled by the control tower 42 could be used, or a cable could be used. Other drive mechanisms could also be used to move the nozzle and/or platform relative to the gantry 34, including gears, drive screws or ball screws, belts, hydraulic lifts, etc.

Figure 9:
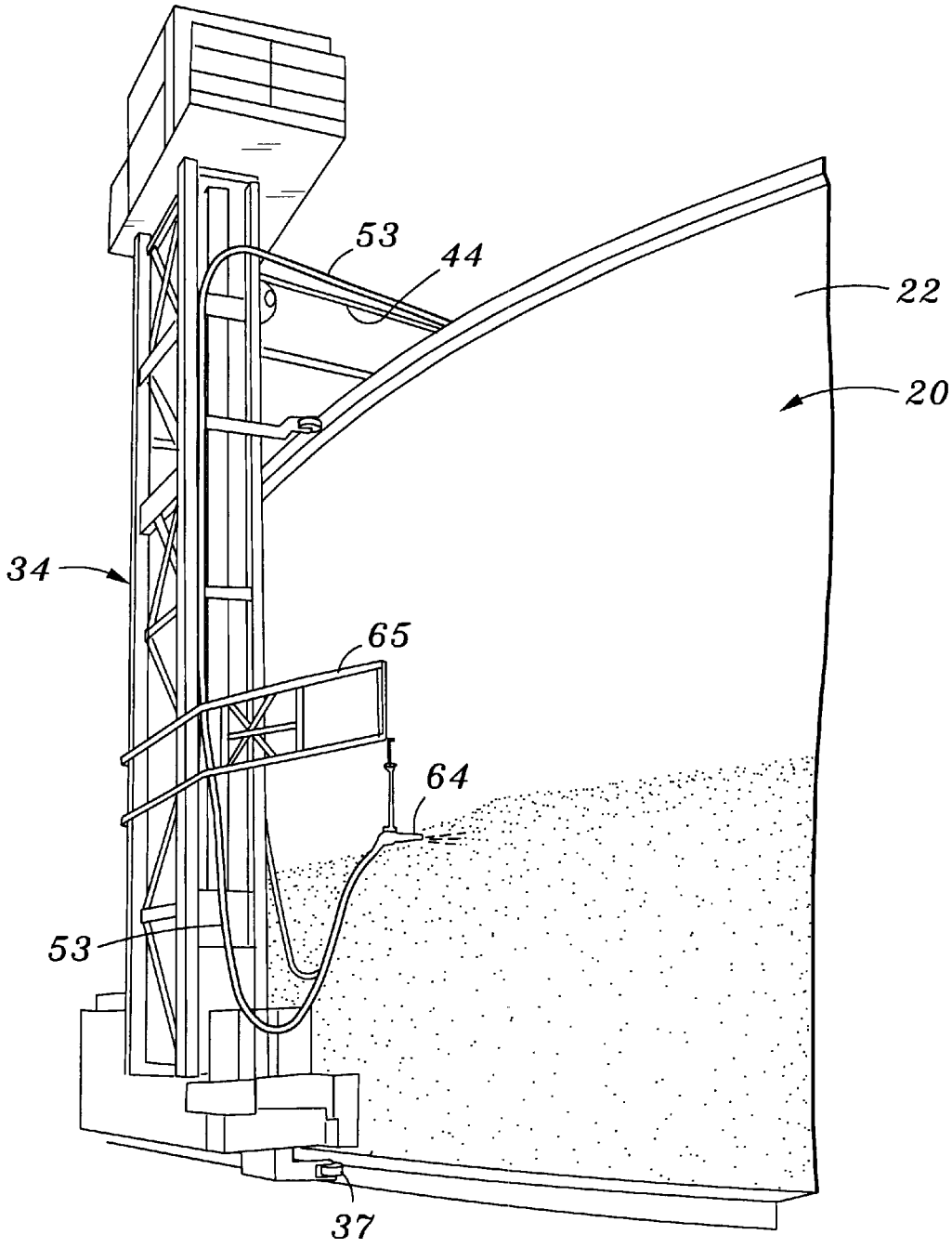
FIG. 9 is a side view of a shotcrete or gunnite spray gun.

Referring to FIG. 9, after the wall 22 is roughened or texturized, the wall is covered with a selected coating material, such as shotcrete or gunnite. The shotcrete or gunnite is typically sprayed onto the wall 22. A spray nozzle 64 for the shotcrete or gunnite is typically fastened to a framework 65 connected to the gantry 34 so the nozzle 64 is at a predetermined distance from the wall suitable for spraying the shotcrete or gunnite. Movement of the framework 65 along a vertical axis relative to the gantry 34, and the movement of the gantry 34 around the circumference of the tank 20, are used to spray the shotcrete or gunnite onto the entire wall 22. The spraying of the shotcrete or gunnite by mounting the sprayer to the platform and then moving the platform and gantry, has been used for many years.

Figure 5:
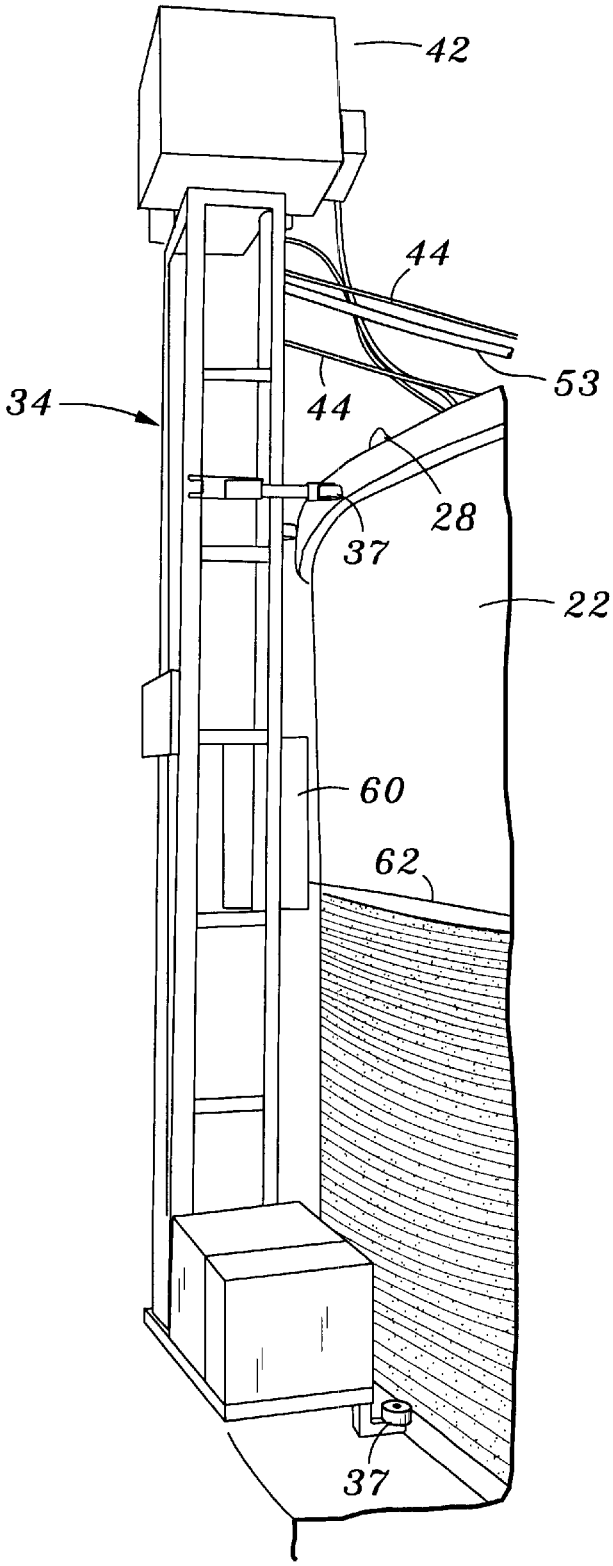
FIG. 5 is a perspective view of a portion of a tank and cable tensioning head.

Referring to FIG. 5, after the shotcrete or gunnite is applied to the wall 22, a wire or cable tensioning head 60 is used to tension a wire or cable 62 around the tank 20. The platform is moved up and down to position the tensioning assembly 60, with the gantry 34 being moved around the periphery of the tank 20 as needed to tension the cables 62. The tensioning head 60 and the platform 40 has been used for many years.

The hydraulic spray nozzle assembly 50 can be mounted on the same platform used to hold the tensioning head 60. That typically requires removing the head 60 and installing the spray assembly 50. A pump 70 driven by pump motor 43 could be permanently mounted to the gantry 34, or could be removably mounted as needed to use the spray assembly 50. A separate gantry 34 could be created specifically for the spray assembly 50, or a platform separately moveable from platform 40, could be added to the gantry 34. A series of filters are provided adjacent the pump 70 so that the water from pump 70 to nozzle assembly 50 lacks particles that would abrade the nozzles. A three stage filter is preferred, with successive filters that filter out 20, 10 and 1 micron sized particles.

As seen in FIGS. 2 and 3, the spray nozzle assembly 50 depends from platform 40. The gantry 34 is "C" shaped and opens toward the wall 22. That allows the platform 40 to move close to the base 24, and allows the depending nozzle 50 to spray the wall 22 adjacent the base 24. If the nozzle assembly 50 were on top the platform 40, it would be difficult to spray the wall adjacent the base 24, and would require either specially designed platforms 40 to remove the latents from the entire wall 22, or a framework placing the nozzle assembly below the platform 40.

The controlled motion of the spray nozzle assembly 50 around the periphery of the tank 20 provides for a uniform texturing of the wall 20, and does so very fast and safely. Previously, manually operated sprayers were attempted where an operator stood on a gantry platform, such as platform 40 with the tensioning head 60 removed, and then manually sprayed the wall with high pressure water. But the pressure from the spray nozzle is so great that the nozzle is held like a rifle, and the operator's shoulder soon becomes sore. Further, the manual spraying is achieved by pivoting the spray gun about the operator's body, which causes the distance between the nozzle and the wall 22 to vary, and that in turn results in uneven texturizing of the curved tank wall. Also, the noise of the manually operated sprayer is such that protective ear-muffs are required. The ejection of the removed concrete surface can also hit the operator. Manual spraying is a noisy, dirty task that produces uneven texturing, at slow rates of about 250 square feet per hour.

In contrast, the present invention can texturize over 1200 square feet per hour, achieve a uniform texturizing, without subjecting the operator to a constant barrage of concrete particles at the same high levels of noise. These advantages are achieved by using a nozzle assembly 50 that is located at a predetermined distance from the contoured walls 22, and a gantry system that moves the nozzle assembly 50 over the surface of the contoured walls 22 to maintain that distance within acceptable limits that maintain the selected surface roughness. The gantry 34 moves the nozzle assembly 50 around the circumference of the cylindrically contoured periphery of the tank.

The walls 22 are ideally curved at a constant radius of curvature, and are ideally perfectly vertical around the entire circumference of the tank 20. That is seldom the case when they are built. Localized areas on the tank wall 22 can be flat, depressed (concave) or bulging (more convex than intended). The base 24 can have localized bulges or depressions. Any of these deviations cause the nozzle assembly 50 to move toward or away from the wall 22. If these conditions occur on more than an isolated basis, it is preferred to slow down the horizontal movement or travel of the gantry 34 and position the nozzle further from the wall, as for example, by use of the jackscrew assembly 61. As the nozzle is further from the wall, it produces a wider pattern, which compensates for the slower travel speed of the gantry 34.

Control Systems

Further advantages arise when the nozzle assembly 50 is controlled to provide uniform texturing of the surface of the curved tank 20, especially when the tanks 20 are made of concrete. The jet of high pressure water described in this disclosure will continually abrade a concrete surface and can actually cut a large hole in a concrete tank. Further, the concrete hardness can vary depending on how recently it has been poured, so a large tank 20 can have sections of the tank that vary greatly in hardness. The ease with which the surface 22*a* of the tank 20 is removed vary greatly with the hardness and density of the concrete. Thus, a constant jet of water from the nozzle assembly 50 may remove too little concrete on some hard areas and remove too much on some areas where the concrete has not cured for very long. Further, the pressure from the jet nozzle assembly 50 varies as the nozzles 52 wear, and that further changes the removal of material from the walls 22. Various controls can be used to address the above difficulties and to provide a more uniform texturizing of the concrete walls 22.

Figure 10:
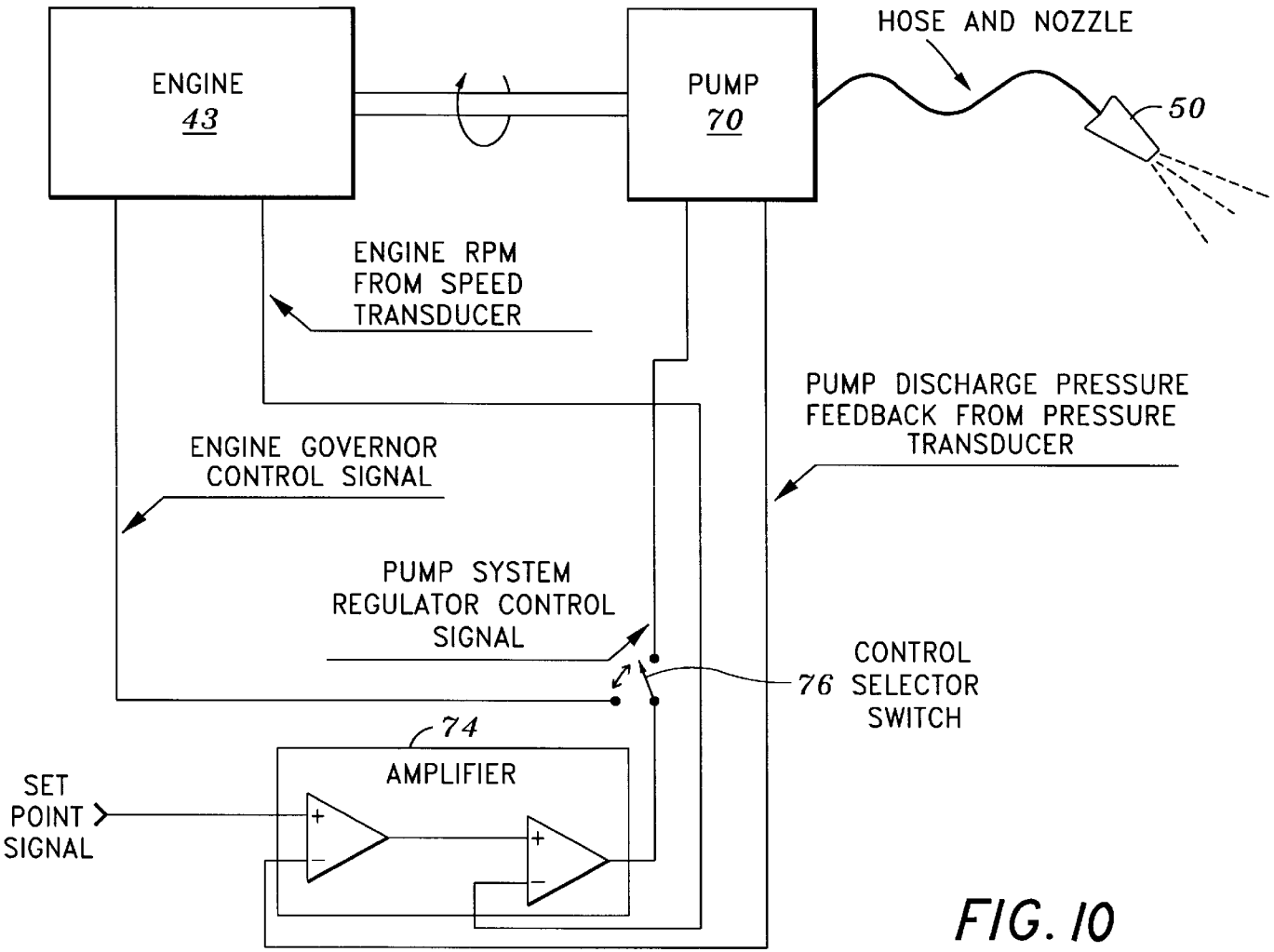
FIG. 10 is a block diagram of a control system for the nozzle of FIG. 2.

Referring to FIGS. 2–3 and 10, the operational controls are preferably centralized in the control tower 42 where an operator can access them. The controls accessible in the control tower 42 preferably include controls to start and stop a motor 41 that drivingly engages wheels 36 to move the gantry 34 around the wall 22. Further controls are provided to start and stop the pump motor 43, and to vary the speed of the motor. Monitors or indicators are provided for the engine oil pressure, temperature, hydraulic pressure when hydraulic devices are used, air pressure when pneumatic devices are used. These types of monitors, indicators or gages and their connections are known in the art and not described in detail.

Gages are also provided to reflect the pump pressure at the inlet and outlet, and to monitor the pressure differential in water filters that remove particles from the water that is pressurized by the pump 70. The high pressure of the water requires filtering to remove the small particulate contaminants that could damage the nozzles 52. These gages, filters etc. and their connections are also known in the art and not described in detail. The controls also preferably include some audio and/or visual alarms, particularly alarms for engine oil pressure, engine temperature, inlet water pressure (cannot allow the pump to run dry), air pressure, hydraulic pressure, and the water filter differential pressure. Such alarms and their connections are known and not described in detail. As mentioned, these various controls, gages and alarms may be operated and monitored remotely by suitable cable communications or wireless communications.

Referring to FIGS. 2 and 10, a control system for the nozzle assembly 50 is shown. A 300 hp engine 43 drives pump 70 which provides pressurized water to the spray nozzle assembly 50. A pump 70 having a flow rate of about 11 g.p.m. at 40,000 psi at 500 rpm is believed suitable. Other motor and pump combinations can be used. Preferably a filter assembly is used in order to remove particulates from the water before the water reaches the spray nozzle assembly 50. As needed, a pre-filter may be needed to filter the water from the local municipal water supply system, or local well, before providing the water to the pump.

The pump and/or motor, or both, are controlled by the operator to provide a constant pressure to the nozzle assembly 50. The orifice 54 (FIG. 4) in each nozzle 52 is typically formed through a very hard material, such as sapphire. Even so, the orifice 54 expands with use. As the orifice 54 gets larger, the water pressure drops. The drop in water pressure reduces the amount of material removed from the wall 22.

To counteract this pressure loss, a pressure transducer 72 (FIG. 11) monitors the discharge pressure from the pump 70 and provides a feedback signal that can be used to control either the motor 43 and/or the pump 70. The transducer 72 could be located at the outlet of pump 70, or within the nozzle assembly 50, or within a chamber immediately adjacent one or more of the orifices 54 (FIG. 4). Plural pressure transducers 72 could also be used.

The signal from the pressure transducer(s) 72 is fed to a comparative amplifier 74 and from there to a control unit cooperating with the engine 43 or the pump 70. As the orifices 54 wear and become larger, the speed of the engine 43 can be increased to maintain a desired pressure at the nozzle assembly 50. Further, some pump designs allow a constant speed motor, but with the pump varying the output pressure. Thus, a control switch 76 is provided to allow either the motor or pump to be controlled to adjust the pressure at the nozzle assembly 50. Of course the control system can be simplified so that only the motor 43 is controlled, or only the pump 70 is controlled to vary the pressure at the nozzle assembly 50. There is thus provided means for maintaining a selected pressure at the nozzle assembly 50 and nozzles 52, to ensure uniform removal of material from the wall 22.

Referring to FIGS. 2–3, a sensor, such as a video camera 80 is advantageously located so that it views the strip 56 shortly after it is formed by the nozzles 50 on the wall 22. A shield 81 can guard the sensor or camera 80 from debris ejected by the removal of the concrete. The sensor 80 allows an operator to adjust the flow through the nozzle assembly 50 to vary the amount of material removed from walls 22 and to adjust the location of the nozzle assembly 50 forming the strip so that adjacent strips 56 abut or overlap by desired amounts. Sensors other than video cameras can be used, including still cameras that take intermittent pictures, or infrared or ultrasonic detectors that can monitor the surface roughness. Further, the sensor 80 could be a contact sensor that contacts the strip 56 to determine its roughness. A lever with one end moving over the strip 56 and a motion detector in communication with the lever to determine movement of the lever, could be used. A variety of roughness detectors could be used given the present disclosure. But a camera 80 is preferred as it provides visual, non-contacting examination.

The camera 80 is preferably mounted so that it moves relative to the gantry 34 along with the nozzle assembly 50. Thus, in the depicted embodiment the camera 80 is mounted to the platform 40 along with the nozzle assembly 50. The camera 80 could be pointed toward the location where the jets of water from the nozzle assembly 50 impact the wall 22, but the ejected debris and spray make it difficult to see much that is useful without damaging the camera. Thus, the camera 80 is preferably located so that the lens of the camera is shielded by shield 81 from the ejected debris and water cloud formed by concrete removal, and the camera 80 is preferably out of the cloud of mist created by the nozzle assembly 50. Further, the camera 80 is advantageously directed at the strip 56 several feet after the nozzle assembly 50 creates the strip.

Preferably, the camera 80 has an adjustable telephoto lens so that the strip 56 can be enlarged or reduced as needed. Further, it is preferably to have the camera 80 mounted so that the orientation of the camera can be changed to view the strip 56 anywhere from the point of creation where the jets of water from the nozzle assembly 50 impact the wall 22, to a point along the same strip 56 located away from the gantry 34. The camera 80 can thus be mounted on an edge of the platform 40 onto which the nozzle assembly 50 is mounted. Preferably there are two cameras 80 on opposing edges of the platform 40, with the nozzle assembly 50 mounted toward the middle of the platform. Thus, one camera 80*a* can view the wall 22 before the impact of the water jet from nozzle assembly 50 that forms strip 54, while the other camera 80*b* views the formation of the strip 56 immediately after its formation. A motor on each camera 80 can rotate the camera to change the field of view, and to change the length of the lens to obtain close-up views of the strip 56, as controlled by the operator. Such controls are known and not described in detail herein.

The image(s) from the camera 80 are transmitted to an operator preferably located in the operator station 42 where they are displayed on one or more video monitors so the operator can view the images. Alternatively, if the operator is controlling the system from a remote location the images can be transmitted by various means known in the art to a remote location for viewing by the operator. The operator can advantageously control the cameras(s) 80 to alter the views from the camera, and can use the views to adjust the flow of water through the nozzle assembly 50 or to change position of the nozzle assembly. Thus, for example, if a portion of the wall 22 has less hardness so the water from the nozzle assembly 50 is removing too much material, the operator can adjust the speed of the engine 43 in order to lower the water pressure and reduce the amount of material removed from the wall 22.

The nozzles 54 can be rotated by a motor, such as an air driven motor, a hydraulically driven motor, or an electric motor. The electric motor is not desirable because the water can conduct electricity. Preferably, the nozzles 54 are rotated by pressure from the water exiting the nozzle itself. Such nozzles can be obtained from various suppliers, including Flow International Corporation in Kent, Wash. and Jetstream in Houston, Tex.

Figure 11:
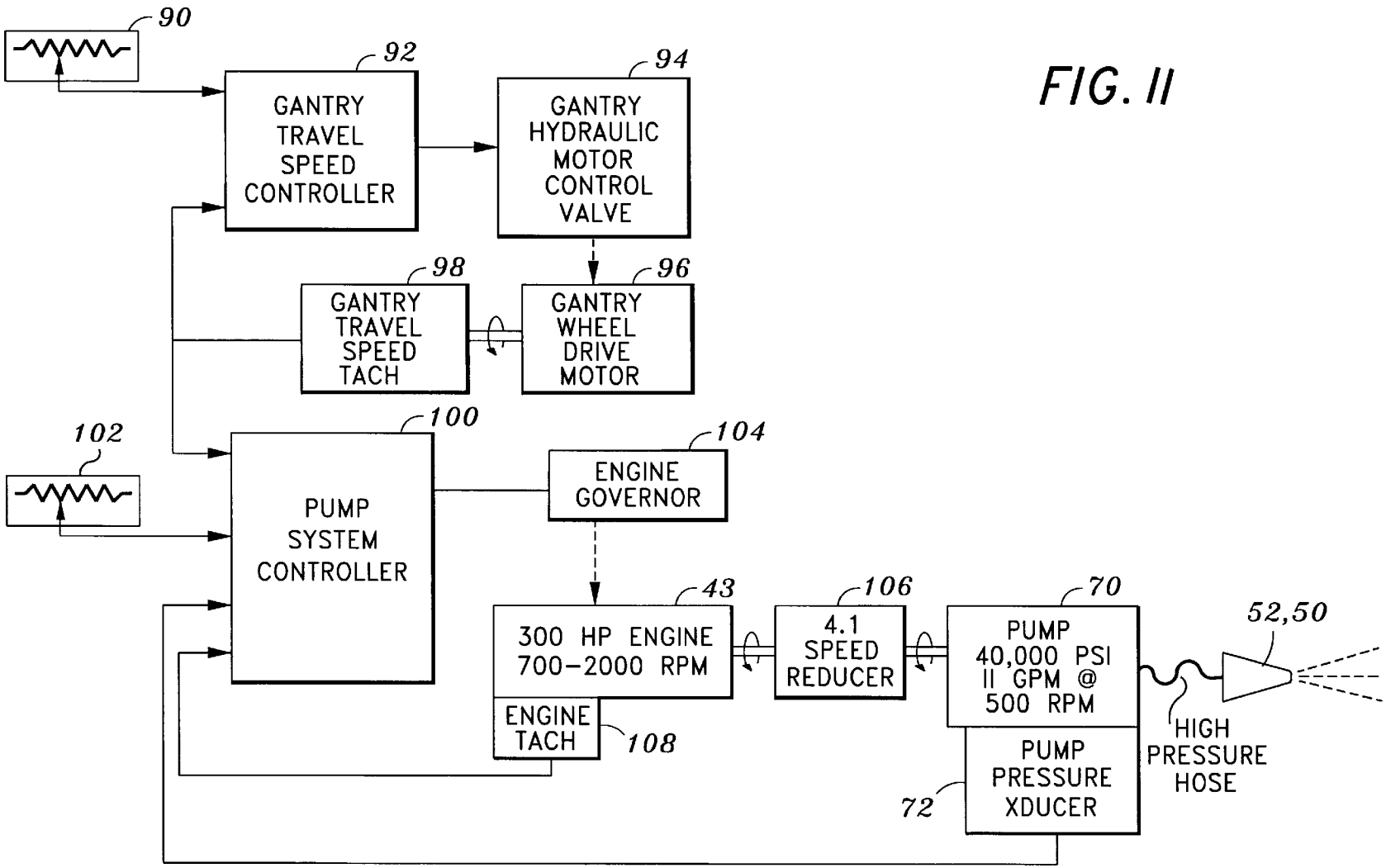
FIG. 11 is a block diagram of a control system for the nozzle of FIG. 2.

Referring to FIGS. 2 and 11, the speed of the gantry 34 is controlled so the jets of water from the nozzles 52 do not bore into the wall 22 an unacceptable amount while the gantry is standing still, or moving too slow. A minimum speed of gantry 34 is input into a gantry speed set point control 90. This speed is the minimum speed at which gantry 34 can move without unacceptably abrading of the wall 22 by the jets of water from nozzle assembly 50 or individual nozzles 52. The minimum gantry speed will vary. For the concrete tanks 20, the speed varies with the hardness and density of the concrete wall 22, the size of the orifice 54 in the nozzles 52, and the distance between nozzles 52 and the wall 22. For nozzles 54 about 0.025 inches diameter, rotating at about 3,000 rpm, about 2.25 inches from the wall 22, and a water pressure of about 40,000 psi, a minimum gantry travel speed of about 50 feet per minute is believed suitable. This is the minimum gantry speed the control system of FIG. 11 seeks to maintain—unless an operator manually controls the speed—in which case the control system varies the water pressure to avoid unacceptable damage to the walls 22. If the travel speed of the gantry 34 falls below this minimum speed, the water pressure must be reduced to a level sufficiently low to prevent unacceptable abrasion of the wall 22.

The set point speed is input into gantry travel speed controller 92. A signal from the controller 92 is used to control the travel speed of the gantry 34. The type of control will vary with the drive mechanism used to move the gantry 34. Preferably, a hydraulic motor is used to move the gantry, so the signal from controller 92 is input to gantry hydraulic control valve 94, which controls a hydraulic pump which in turn controls a drive motor 96 in driving communication with one of the wheels 36 of the gantry 34. The hydraulic motor 96 is powered by a hydraulic system operated by gantry motor 41. The travel speed of the gantry 34 is preferably monitored by a tachometer 98. A signal representative of the travel speed of gantry 34 is sent to the controller 92, and is optionally, but preferably, also sent to a pump system controller 100.

The gantry controller 92 can be used to maintain the travel speed of the gantry 34 at a speed that texturizes the wall 22. But the operator can override the speed, and typically manually controls the speed depending on observations of the strip 56 using video camera 80 or some other indicator of the texture of the strip 56. The travel speed as preferably reflected by a signal from the tachometer 98, and that signal is fed to the pump system controller 100 that can shut-off the pump or reduce the pressure to nozzle assembly 50 to avoid undesirable damage to wall 22.

The pump system controller 100 can be used to control the pressure the pump 70 provides to the nozzles 52. A pump pressure set point input control 102 is provided which sets the pump pressure that is desired to be maintained. An input control 102 can also provide the pressure that will be maintained if the travel speed of the gantry 34 is below a predetermined speed. The system controller controls the speed of the pump motor 43, preferably through a governor 104. The controller preferably maintains a predetermined, operating pump pressure sufficient to texturize the wall 22 to a desired roughness. The motor 43 drives pump 70 though a gear reducer 106. A gear reduction of about 4:1 for a 300 hp motor operating between 780–2000 rpm is believed suitable. The speed of the pump motor 43 is monitored by tachometer 108, while the pressure of pump 70 is monitored by pressure transducer 72. Signals from the tachometer 108 and pressure transducer 72 are sent to the pump system controller 100. Thus, the controller 100 can vary the engine speed to vary the pressure to nozzles 52 and maintain a desired pressure to texturize the wall 22 to a desired roughness. For the system described relative to FIG. 11, a pressure of about 40,000 psi, at about 11 gallons per minute and 500 rpm of the pump 70, is believed suitable. A pressure of about 36,000–40,000 psi is believed to be preferred. Flow rates from as little as 2 gallons per minute up to 20 gallons per minute are believed possible. But the more common flow rates are expected to be from about 6–12 gallons per minute.

When the gantry travel speed falls too low so the nozzles 52 begin to unacceptably damage wall 22, the tachometer signal 98 as monitored by controller 100 and compared to a set point signal from control 102, causes the controller 100 to lower the pressure to nozzles 52. This lower pressure is achieved by lowering the engine speed through governor 104, or in some cases by lowering the pump speed if the pump design allows it. Similarly, when the gantry 34 first begins moving, the controller 100 does not permit the water pressure to the nozzles 52 and nozzle assembly 50 to reach a pressure sufficient to texturize the walls 22 until the speed of the gantry 34 reaches a predetermined level. There is thus advantageously provided a means for controlling the water pressure to the nozzles 52 and nozzle assembly 50 to avoid unacceptable abrasion of the wall 22, or to avoid unacceptable damage to the wall 22.

Figure 12:
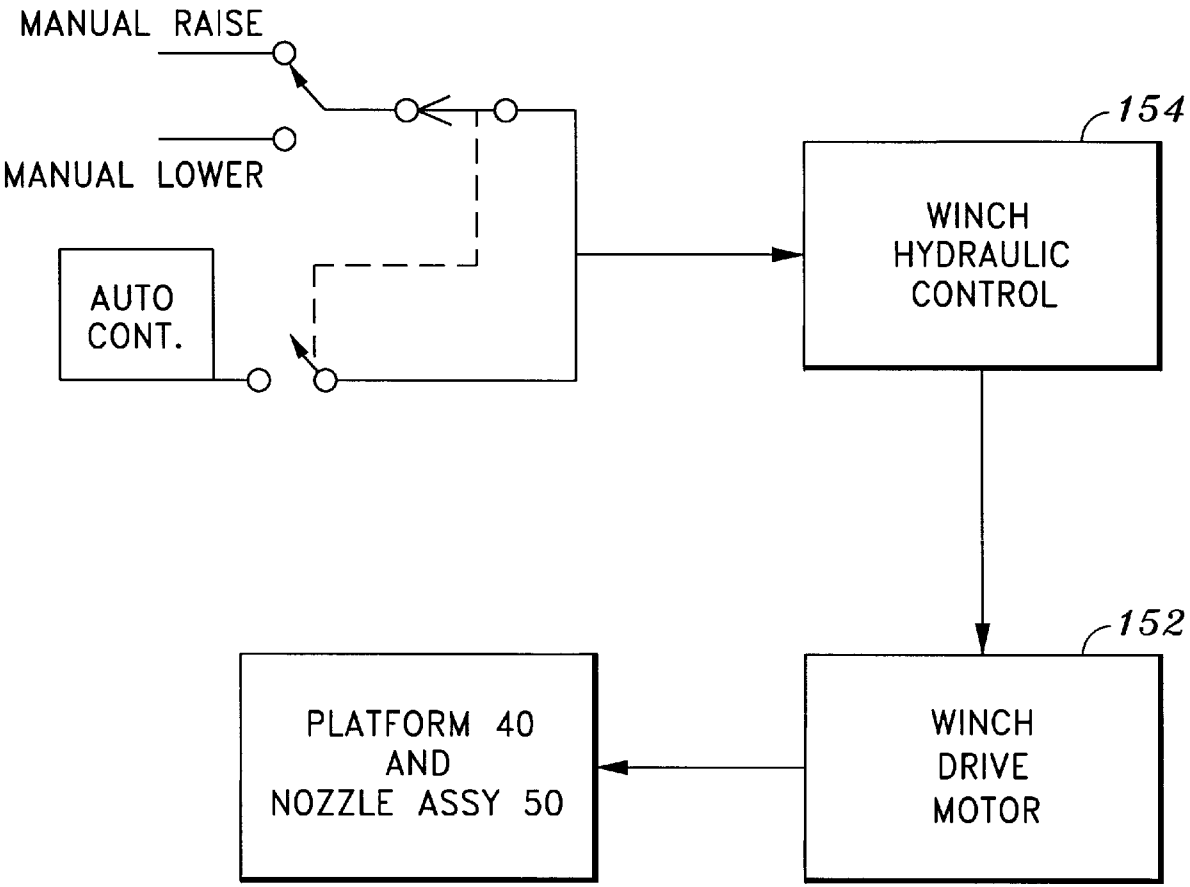
FIG. 12 is a block diagram of a control system for raising and lowering a platform to which the spray nozzle of this invention is mounted.

Referring to FIG. 12, a control system for raising and lowering the nozzle assembly 50 relative to the gantry 34 and tank 20 is shown. The nozzle assembly 50 is mounted to platform 40, and the platform is movably mounted to gantry 34 so the platform can move vertically up and down relative to the gantry and also relative to the tank 20. The platform 40 is connected to a series of cables 150 (FIG. 3) connected to move platform 40 relative to gantry 34 without jamming the platform. The cables 150 are in turn connected to a winch system rotated by a motor 152 that is preferably hydraulically powered. The winch motor 152 is advantageously controlled by a winch hydraulic control system 154 by an operator in operator station 42, or by an operator at a remote location. The control system 154 allows advantageously allows a manual control of the raising or lowering of platform and attached nozzle assembly 50. Alternatively, the control system can provide automatic control of the raising and/or lowering by programming an incremental position change based on the travel of the gantry 34. A microprocessor can accommodate the pertinent control needs. Such control systems are believed to have been previously known for use in positioning cable tensioning heads mounted on the platform 40, and thus will not be described in further detail.

Thus, the platform 40 may be raised an incremental distance by the operator, or raised an incremental distance for a specified travel of the gantry 34 around the periphery of the tank 20. For example, if the tank 20 has a circumference of 10,000 inches and the platform 40 and nozzle assembly 50 is to be raised 4.5 inches (the width of an exemplary strip 56) during one revolution of the gantry 34 around the circumference, then the winch drive motor 152 moving the platform 40 can be set to achieve that movement of the platform and nozzle. Alternatively, the operator could specify that the platform 40 be raised 4.5 inches in a specified distance, say two feet, every time the operator passed an identifiable location on the tank, such as a joint on the roof 23. Incremental vertical movements as small as 0.1 to 0.2 inches are possible.

While the positioning of nozzle assembly 50 is described relative to the positioning of the platform 40, a separate positioning control system could be provided to directly move the nozzle assembly 50 relative to the gantry 40, or even relative to the platform 40, or both.

Figure 13:
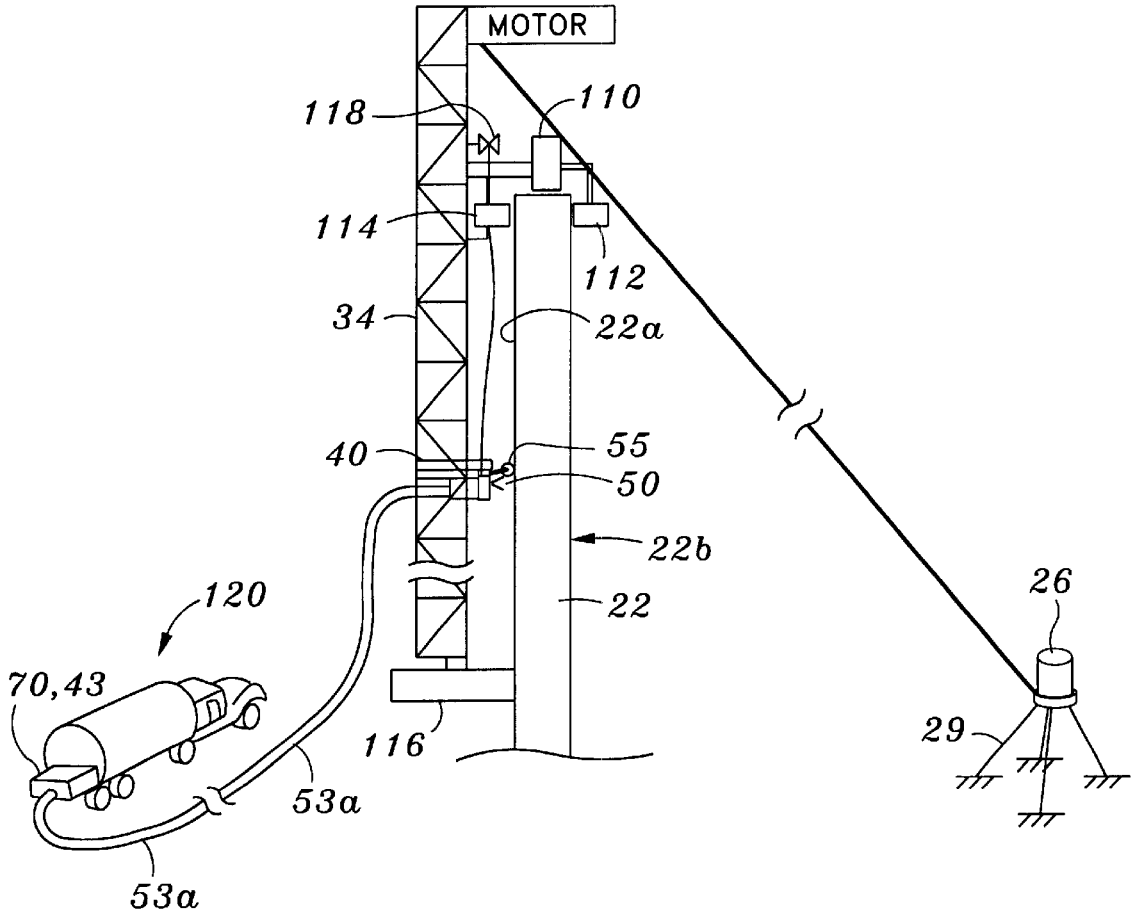
FIG. 13 is a side view of an alternative embodiment with a spray nozzle suspended from the top of a tank wall.
Figure 14:
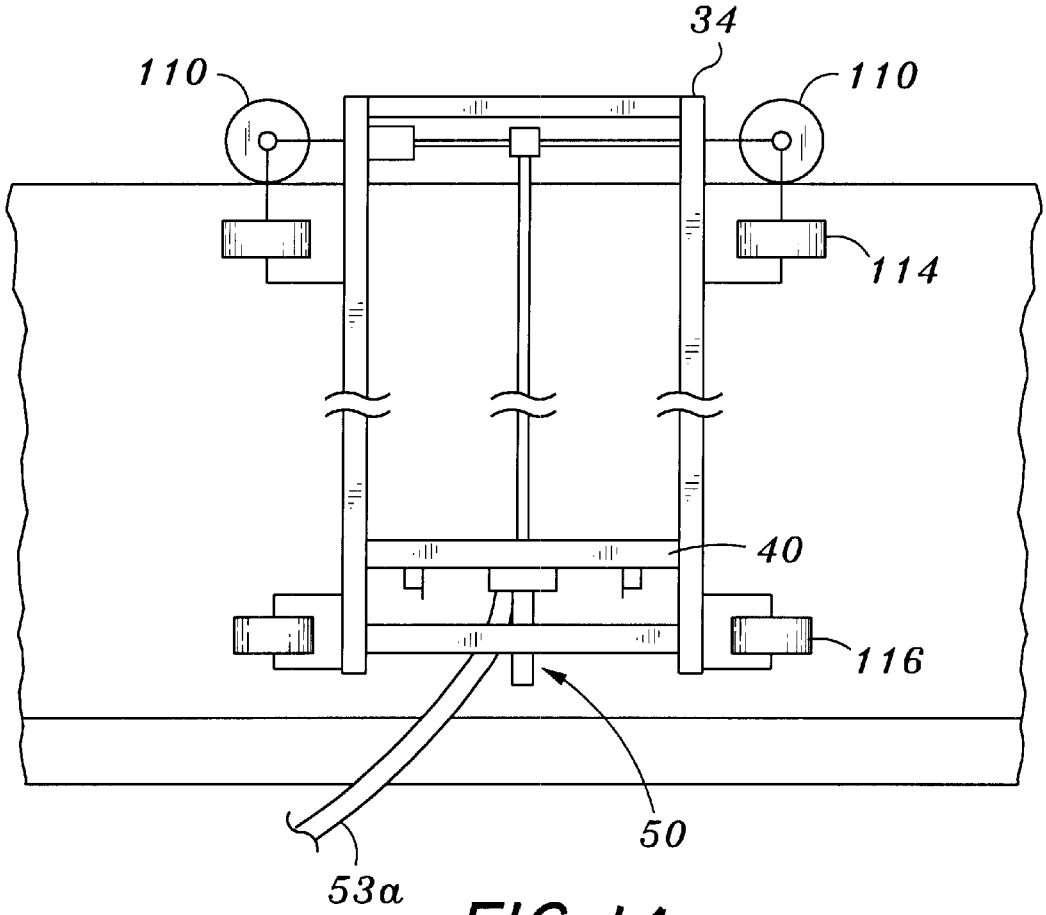
FIG. 14 is a front plan view of the embodiment of FIG. 13.
Figure 15:
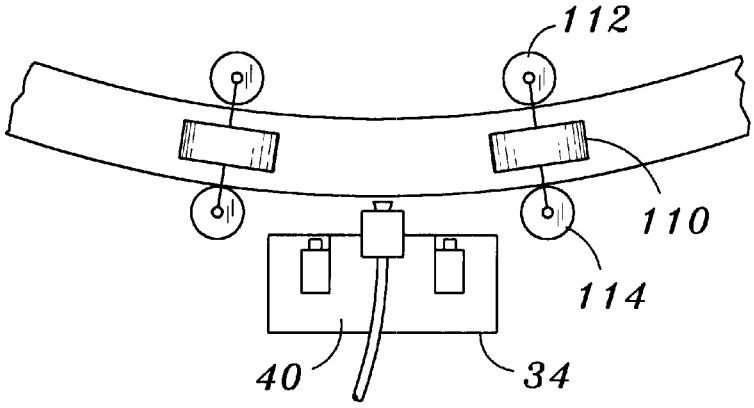
FIG. 15 is a top plan view of the embodiment of FIG. 13.

Referring to FIGS. 13–15, a further embodiment is shown in which a gantry 34 is suspended from the top of the wall 22. Wheels 110 roll on the top of the walls 22. Centering wheels 112 abutting the inside of the tank, and wheels 114 abutting the outside of the tank, maintain the wheels 110 on the wall. The wheels 110, 112, 114 are connected to the gantry to hang the gantry from the wheels. Bottom wheels 116 connected to the lower portion of the gantry 34 near the ground, keep the gantry aligned with the wall 22. The platform 40 holding spray assembly 50 in fluid communication with a source of pressurized water via hose 53 is used to texturize the wall 22. A motor driven pulley 118 is used to raise and lower the platform 40. To reduce the weight suspended from the wall 22, the pump 70 and its motor 43 may be mounted on a water truck 120 or other vehicle containing water reservoir 51. Alternatively, they may be mounted to the gantry 34 and supported by the wall 22.

Figure 16:
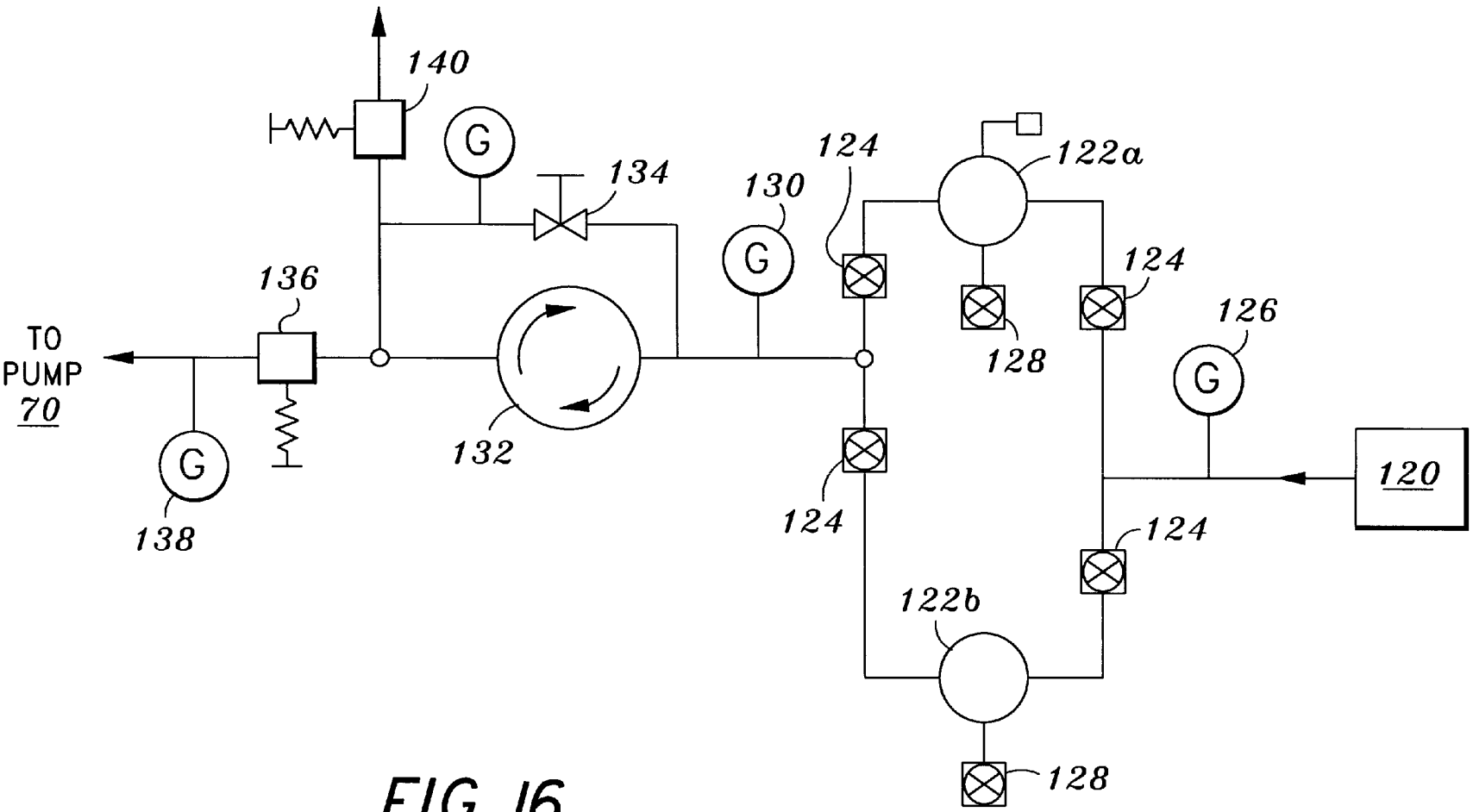
FIG. 16 is a schematic diagram of a pre-filter and pump system for use with this invention.

Referring to FIG. 16, a filter and pressure assembly is provided to ensure adequate pressure of filtered water to the system. The nozzle assembly requires filtered water, and filters are provided as part of the pump assembly. But the filters will clog if the water supplied to them is very dirty. Further, the water main or water supply may not have adequate pressure to supply water to the gantry 34, so it is helpful to have a pressurization system to ensure adequate water flow to the pump 70. Such a system is shown in FIG. 16. Water from a water source 120, such as a water main, is sent through one of two filters 122*a, b.* A 75 micron filter is believed suitable. At least one shut off valve 124 (preferably with an integral check valve to prevent backflow) controls the flow to each filter 122 so that one of the filters 122*a*, 122*b* could be bypassed while it is cleaned. Advantageously there are shut-off valves 124 before and after each filter 122. Drain valves 128 allow draining of the filter(s) 122. The pressure at the water source is measured by a pressure gage 126. The pressure on the water out of filters 122 is measured by gage 130. A pump 132 moves the water from filter(s) 122 through a metering valve 134 and pressure regulator 136 so the pressure monitored by outlet gage 138 and flow rate can be set as desired. A pressure relief valve 140 is also provided to prevent excessive pressure.

The filtered water is pumped by pump 132 to the pump 70. By adjusting the pressure regulator 136 and metering valve 134 the volume and pressure of filtered water provided to pump 70 can be adjusted to achieve a constant flow and pressure at the pump 70. Advantageously, an adequate flow of filter water at about 25 psi to 125 psi is provided to the pump 69*m* where it is forced through further filtering before being passed to nozzle assembly 50.

The above description is given by way of example, and not limitation. Given the above disclosure, one skilled in the art could devise variations that are within the scope and spirit of the invention. Thus, the use of two or more nozzle assemblies 50 could be used in parallel to produce adjacent strips 56. Moreover, the above description is given for a cylindrical concrete tank 20, but other tanks can be used, including steel tanks or tanks with walls that are not curved or not uniformly curved. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

We claim:

1. A method for texturizing an interior or exterior surface of a cylindrical storage tank having a concrete wall with an exposed concrete surface on the wall, comprising:

placing a rotating spray nozzle assembly having a plurality of nozzles so the nozzles maintain a predetermined distance from the tank surface during operation of the nozzles;

moving the nozzle assembly over the cylindrical surface while maintaining the predetermined distance and while forcing a jet of water through the nozzles with sufficient velocity and flow to remove an exterior layer of concrete from the exposed concrete surface along a strip having a width and a length, in order to provide a predetermined texture to the concrete surface of the wall.

2. The method of claim 1, wherein the predetermined texture of the surface is an ICRI roughness of 5–6, over at least 95% of the surface.

3. The method of claim 1, wherein the placing step comprises fastening the nozzle assembly to a structure that is constrained to move around a circumference of the tank, and further fastening the nozzle assembly to a moveable platform on the structure which platform can move along a vertical axis.

4. The method of claim 3, wherein the moving step comprises moving the structure and nozzle assembly around the circumference of the tank.

5. The method of claim 4, wherein the moving step further comprises moving the platform and nozzle assembly along the vertical axis.

6. The method of claim 3, wherein the moving step further comprises moving the platform and nozzle assembly along the vertical axis.

7. The method of claim 3, wherein the moving step comprises moving the nozzle assembly in a spiral pattern around the tank so that strips of removed material slightly overlap for substantial portions of the length of the strips.

8. The method of claim 3, wherein the moving step comprises moving the nozzle assembly in a spiral pattern around the tank so that the strips of removed material do not overlap for substantial portions of the length.

9. The method of claim 1, further comprising viewing the strip through a camera to obtain information for use in obtaining the predetermined texture of the surface.

10. The method of claim 1, wherein the water flows through the nozzles at a pressure, and the pressure is varied to compensate for wear of the nozzles and maintain the predetermined texture of the surface.

11. The method of claim 1, further comprising determining the rate of travel of the nozzle and regulating the flow of water through the nozzle so that water does not impact the surface with sufficient pressure to texturize the surface below a specified rate of travel.

12. A concrete storage tank having a surface, over 95% of which is roughened by the method of claim 1.

13. The method of claim 1, wherein the spray nozzle and distance of the nozzle to the surface of the tank and water pressure to the nozzle and movement of the gantry are selected to produce an ICRI roughness of 5–6 over 90% of the surface sprayed.

14. The method of claim 1, further comprising controlling the pressure to the nozzle to provide at least two gallons per minute of water at over 20,000 pounds per square inch to the nozzle.

15. The method of claim 1, further comprising supporting a camera off the gantry and located and orientated to provide an image of the wall at the location where, and shortly after, the strip of material is removed by the nozzle.

16. The method of claim 1, further comprising locating a shield intermediate the nozzle and the platform, the shield being configured to block a majority of the debris ejected from the walls from hitting the platform during removal of material from the exterior surface of the tank.

17. The method of claim 1, further comprising connecting a roller to a frame to which the nozzle is connected and placing the roller in contact with the wall adjacent the nozzle to maintain the predetermined distance between the nozzle and the wall, and mounting the nozzle to allow movement relative to the platform along an axis generally perpendicular to the wall.

18. A method of making a concrete storage tank, comprising:

forming a cylindrical tank having a vertical wall made of concrete, the tank having a base extending radially outward from the walls;

tethering a gantry from a center pin extending from a portion of the storage tank, the gantry configured to move around a circumference of the tank on the base as constrained by the tether, the gantry having a platform that can be moved upwards and downwards relative to the gantry and having a spray nozzle assembly mounted to the platform so the nozzle assembly can move around, and up and down an exterior surface of the tank;

moving the nozzle assembly over the exterior surface of the tank at a predetermined distance from the surface while spraying high pressure water through the nozzle assembly to provide a predetermined texture to the exterior surface of the concrete over at least 90% of the surface;

spraying a coating material on the texturized surface;

placing one of cables, wires and bars over the texturized surface covered by the coating material and placing the one of the cables, wires and bars under tension to stress the wall.

19. The method of claim 18, wherein the surface is texturized to an ICRI roughness of 5–6, over at least 90% of the surface.

20. The method of claim 18, further comprising, placing the spray nozzle assembly in fluid communication with a source of water through an opening in the top of the tank.

21. The method of claim 18, wherein the nozzle assembly moves at a speed which is monitored and wherein the water pressure to the nozzle assembly is maintained at a pressure selected to avoid unacceptable roughening of the concrete wall unless the speed of the nozzle assembly is above a predetermined level, in order to prevent unacceptable damage to the wall.

22. The method of claim 18, comprising comparing a signal representative of a rate at which the gantry is moving with a signal representative of a predetermined rate of travel, and varying the pressure of the water to the nozzle assembly to vary the texture of the wall produced by the nozzle assembly.

23. A concrete storage tank having a surface, over 95% of which is roughened by the method of claim 18.

24. The method of claim 18, further comprising providing a controller on a pump motor providing pressurized water to the nozzle, the controller having a first input representative of a speed at which the nozzle moves relative to the tank and having a second input representative of the water pressure at the nozzle, and having an output signal representative of a desired engine speed to achieve a pressure at the nozzle that is not sufficient to remove concrete from the tank wall opposite the nozzle.

25. A method for texturizing an interior or exterior surface of a cylindrical storage tank, comprising:

placing a rotating spray nozzle assembly having a plurality of nozzles so the nozzles maintain a predetermined distance from the tank surface during operation of the nozzles;

moving the nozzle assembly over the cylindrical surface while maintaining the predetermined distance and while forcing a jet of water through the nozzles with sufficient velocity and flow to remove an exterior layer from the surface along a strip having a width and a length, in order to provide a predetermined texture to the surface; and viewing the strip through a camera to obtain information for use in obtaining the predetermined texture of the surface.

26. A method for texturizing an interior or exterior surface of a cylindrical storage tank, comprising:

placing a rotating spray nozzle assembly having a plurality of nozzles so the nozzles maintain a predetermined distance from the tank surface during operation of the nozzles;

moving the nozzle assembly over the cylindrical surface while maintaining the predetermined distance and while forcing a jet of water through the nozzles with sufficient velocity and flow to remove an exterior layer from the surface along a strip having a width and a length, in order to provide a predetermined texture to the surface; and supporting a camera off the gantry, which camera is located and orientated to provide an image of the wall at the location where, and shortly after, the strip of material is removed by the nozzle.

27. A method of making a concrete storage tank, comprising:

forming a cylindrical rank having a vertical wall made of concrete, the tank having a base extending radially outward from the walls;

tethering a gantry from a center pin extending from a portion of the storage tank, the gantry configured to move around a circumference of the tank on the base as constrained by the tether, the gantry having a platform that can be moved upwards and downwards relative to the gantry and having a spray nozzle assembly mounted to the platform so the nozzle assembly can move around, and up and down an exterior surface of the tank;

moving the nozzle assembly over the exterior surface of the tank at a predetermined distance from the surface while spraying high pressure water through the nozzle assembly to provide a predetermined texture to the exterior surface of the concrete over at least 90% of the surface;

placing one of cables, wires and bars over the texturized surface covered by the coating material and placing the one of the cables, wires and bars under tension to stress the wall.

28. The method of claim 27, wherein the surface is texturized to an ICRI roughness of 5–6, over at least 90% of the surface.

29. The method of claim 27, further comprising, placing the spray nozzle assembly in fluid communication with a source of water through an opening in the top of the tank.

30. The method of claim 27, herein the nozzle assembly moves at a speed which is monitored and wherein the water pressure to the nozzle assembly is maintained at a pressure selected to avoid unacceptable roughening of the concrete wall unless the speed of the nozzle assembly is above a predetermined level, in order to prevent unacceptable damage to the wall.

31. A method of making a concrete storage tank, comprising:

forming a cylindrical tank having a vertical wall made of concrete, the tank having a base extending radially outward from the walls;

moving a nozzle assembly over the exterior surface of the tank at a predetermined distance from the surface while spraying high pressure water through the nozzle assembly to provide a predetermined texture to the exterior surface of the concrete over at least 90% of the surface;

spraying a coating material on the texturized surface;

placing one of cables, wires and bars over the texturized surface covered by the coating material and placing the one of the cables, wires and bars under tension to stress the wall.

* * * * *